US012714195B1

(12) United States Patent
Worrell-Leniger

(10) Patent No.: US 12,714,195 B1
(45) Date of Patent: Aug. 25, 2026

(54) HEEL STABILIZER APPARATUS

(71) Applicant: Jacob Worrell-Leniger, Nashville, TN (US)

(72) Inventor: Jacob Worrell-Leniger, Nashville, TN (US)

( * ) Notice: Subject to any disclaimer, the term of this patent is extended or adjusted under 35 U.S.C. 154(b) by 0 days.

(21) Appl. No.: 19/402,966

(22) Filed: Nov. 26, 2025

(51) Int. Cl.
*A43B 21/24* (2006.01)
*A43B 21/32* (2006.01)

(52) U.S. Cl.
CPC ..... *A43B 21/24* (2013.01); *A43B 21/32* (2013.01)

(58) Field of Classification Search
CPC ..... A43B 21/00; A43B 21/24; A43B 21/32
See application file for complete search history.

(56) References Cited

U.S. PATENT DOCUMENTS

| | | | | |
|---|---|---|---|---|
| 1,948,967 A | | 2/1934 | Jassen | |
| 3,182,409 A | | 5/1965 | Leidgens | |
| 3,200,518 A | * | 8/1965 | Rasmussen | A43B 21/36 D2/966 |
| 3,266,177 A | | 8/1966 | Holden | |
| 10,750,818 B2 | | 8/2020 | Rogers et al. | |
| 11,464,288 B1 | | 10/2022 | Baker | |
| 2012/0047770 A1 | | 3/2012 | Dean et al. | |
| 2015/0052777 A1 | | 2/2015 | Jennings | |
| 2017/0079379 A1 | | 3/2017 | Singh et al. | |
| 2017/0340051 A1 | | 11/2017 | Rogers et al. | |
| 2022/0151340 A1 | | 5/2022 | Go | |

FOREIGN PATENT DOCUMENTS

| | | | | |
|---|---|---|---|---|
| CN | 108113113 A | * | 6/2018 | A43B 7/38 |
| KR | 20110015179 A | * | 2/2011 | A43B 21/30 |

OTHER PUBLICATIONS

Translation of CN-108113113 (Year: 2018).*
Translation of KR-20110015179 (Year: 2011).*

* cited by examiner

*Primary Examiner* — Ted Kavanaugh
(74) *Attorney, Agent, or Firm* — Patterson Intellectual Property Law, P.C.; Samuel A. Raque

(57) ABSTRACT

A heel stabilizer apparatus for a shoe comprises a shell with a base, at least one slot in a sidewall, a rod movably arranged relative to the shell, and a leg movably coupled to the rod. Movement of the shell relative to the rod from a first to second position moves the leg to protrude through the slot. A leg resilient element biases the leg to protrude through the slot. A compression post couples to the shell, with a spring positioned between the leg and compression post. The shell has a shell bore with interior surface, and the leg has an exterior contact surface contacting the shell bore in the first position. A resilient element between rod and shell biases them to the first position. The shell comprises a foot pad, and the leg comprises a leg foot pad.

18 Claims, 10 Drawing Sheets

HEEL STABILIZER APPARATUS

FIELD OF INVENTION

The present disclosure relates to footwear stabilization devices, and more particularly to a heel stabilizer apparatus with retractable legs that deploy from a shoe heel to provide enhanced stability when force is applied.

BACKGROUND

High-heeled footwear, particularly stilettos and other narrow-heeled shoes, presents ongoing challenges related to stability and comfort during wear. The narrow contact area between the heel and the ground creates inherent instability that can lead to difficulty walking, particularly on uneven surfaces or when navigating stairs and other obstacles.

Traditional high-heeled shoes concentrate the wearer's weight on a small heel tip, often measuring less than a quarter inch in diameter. This concentration of force creates high ground pressure and can result in the heel sinking into soft surfaces, getting caught in grates or cracks, or causing the wearer to lose balance. The instability is compounded by the elevated position of the foot, which shifts the wearer's center of gravity forward and places additional stress on the forefoot.

Various approaches have been attempted to address stability concerns in high-heeled footwear. Some manufacturers have experimented with wider heel bases or platform designs, but these modifications often compromise the aesthetic appeal that makes high heels desirable. Other solutions have focused on internal cushioning or arch support, which may improve comfort but do not directly address the fundamental stability issues created by the narrow heel-to-ground contact area.

The footwear industry continues to seek solutions that can provide enhanced stability for high-heeled shoes while maintaining their visual appeal and elegance. There remains a need for mechanisms that can dynamically adjust the contact area between the heel and the ground to provide better stability when needed, while preserving the sleek appearance of traditional high-heeled footwear during normal wear.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

According to an aspect of the present disclosure, a heel stabilizer apparatus for a shoe is provided. The apparatus comprises a shell comprising a base. The apparatus comprises at least one slot arranged in a sidewall of the shell. The apparatus comprises a rod movably arranged relative to the shell. The apparatus comprises a leg movably coupled to the rod. A movement of the shell relative to the rod from a first position to a second position moves at least a portion of the leg to protrude through the at least one slot.

According to other aspects of the present disclosure, the apparatus may comprise one or more of the following features. The apparatus may further comprise a leg resilient element coupled with the leg. The leg resilient element may be configured to bias the leg to protrude through the at least one slot. The apparatus may further comprise a compression post coupled to the shell. The leg resilient element may comprise a spring positioned between the leg and at least a portion of the compression post. The leg may comprise a leg interior groove. The spring may comprise a leaf spring. At least a portion of the leaf spring may be arranged in the leg interior groove. The shell may comprise a shell bore forming an interior surface of the shell. The leg may comprise an exterior contact surface configured to contact the shell bore in the first position. The shell bore may comprise a shell bore chamfer adjacent the at least one slot. The exterior contact surface may be configured to contact the shell bore chamfer in the second position. The leg may comprise a faceted top surface. The faceted top surface may comprise a top contact surface and a side contact surface. The top contact surface may be configured to contact a bottom surface of the rod in the second position. The side contact surface may be configured to contact the compression post in the second position. The apparatus may further comprise a resilient element arranged between the rod and the shell. The resilient element may be configured to bias the rod and the shell to the first position. The rod may comprise a rod bore. The resilient element may be arranged in the rod bore. The resilient element may comprise a helical spring. The rod may comprise a top post. The shell may comprise a compression post. The resilient element may be arranged between the top post and the compression post. The shell may comprise a foot pad configured to contact a ground surface. The leg may comprise a leg foot pad configured to contact the ground surface in the second position. The leg foot pad may not contact the ground surface in the first position. In the first position, the leg may be in a retracted state entirely within an envelope of an outer surface of the shell.

According to another aspect of the present disclosure, a method of operating a heel stabilizer apparatus for a shoe is provided. The method comprises providing a heel stabilizer apparatus comprising a shell having a base and at least one slot arranged in a sidewall of the shell, a rod movably arranged relative to the shell, and a leg movably coupled to the rod. The method comprises applying a force to the heel stabilizer apparatus. The method comprises moving the shell relative to the rod from a first position to a second position in response to the applied force. The method comprises moving at least a portion of the leg to protrude through the at least one slot as the shell moves from the first position to the second position.

According to other aspects of the present disclosure, the method may comprise one or more of the following features. The method may further comprise biasing the leg to protrude through the at least one slot via a leg resilient element coupled with the leg. The method may further comprise biasing the rod and the shell to the first position via a resilient element arranged between the rod and the shell.

The foregoing general description of the illustrative embodiments and the following detailed description thereof are merely exemplary aspects of the teachings of this disclosure and are not restrictive.

BRIEF DESCRIPTION OF FIGURES

Non-limiting and non-exhaustive examples are described with reference to the following figures.

DETAILED DESCRIPTION

The present disclosure relates to various aspects of a heel stabilizer apparatus for footwear. The apparatus may be configured to enhance stability in high-heeled shoes through a deployable leg mechanism that extends from a heel structure in response to applied force.

The following description sets forth exemplary aspects of the present disclosure. It should be recognized, however, that such description is not intended as a limitation on the scope of the present disclosure. Rather, the description also encompasses combinations and modifications to those exemplary aspects described herein.

Figure 1:
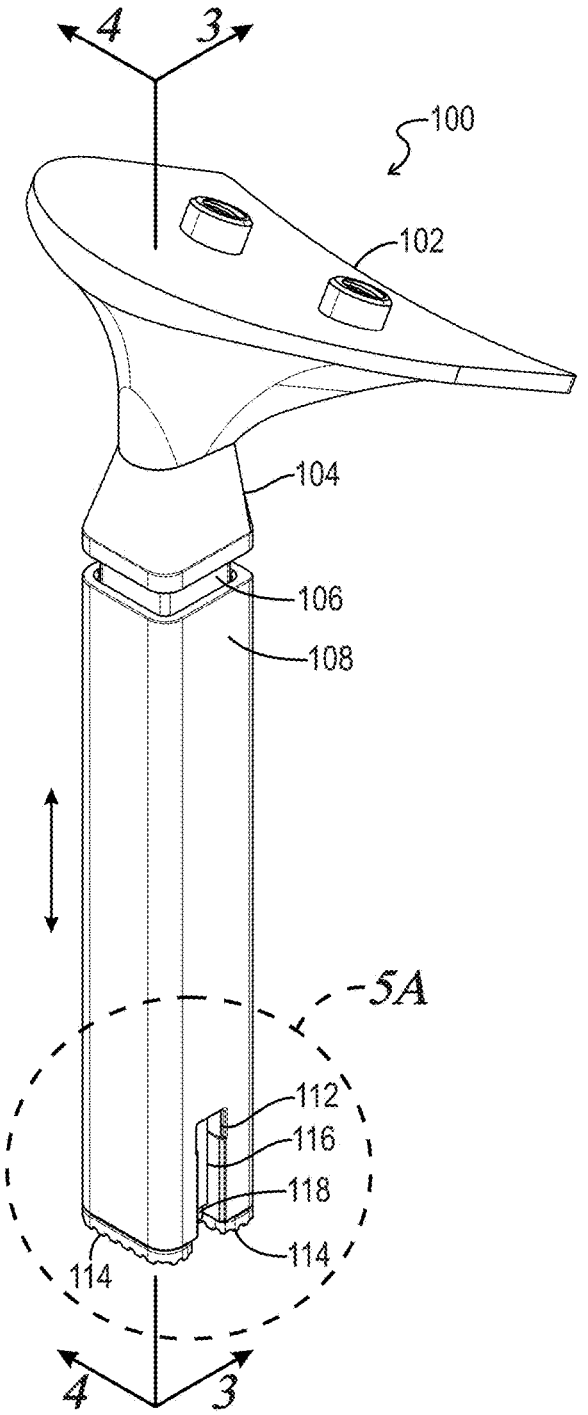
FIG. 1 illustrates a side view of a heel stabilizer apparatus, according to aspects of the present disclosure.
Figure 2:
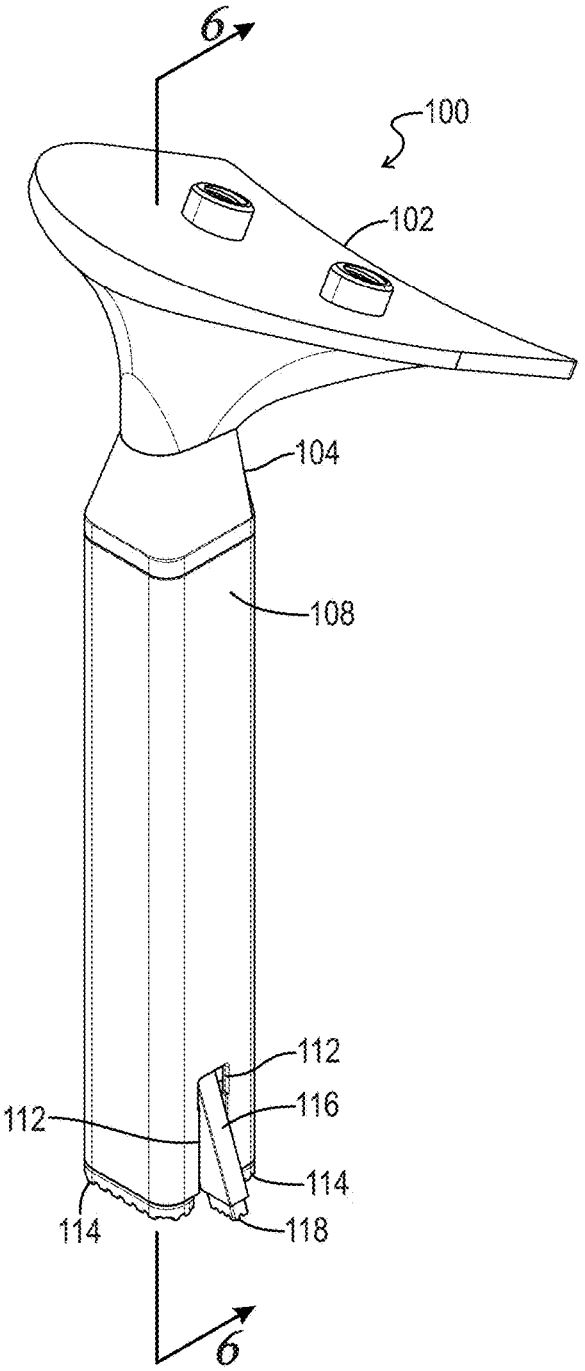
FIG. 2 depicts a perspective view of the heel stabilizer apparatus of FIG. 1, according to aspects of the present disclosure.

Referring to FIGS. 1 and 2, a heel stabilizer apparatus 100 may be configured for use with a shoe to enhance stability in high-heeled footwear through a deployable leg mechanism. The heel stabilizer apparatus 100 may provide improved balance and support by deploying stabilizing elements when force is applied, thereby reducing instability commonly associated with narrow heel tips in stiletto-style footwear.

As shown in FIG. 1, the heel stabilizer apparatus 100 may include a heel connection 102 positioned at an upper portion of the apparatus. The heel connection 102 may be configured to provide attachment to remaining portions of a shoe, particularly to a sole of the shoe. In some cases, the heel connection 102 may be shaped according to different style shoes and may be customizable based on particular shoe type, color, style, or other design factors.

The heel connection 102 may be configured in various forms and may not be limited to any particular connection type, structure, or shape. The heel connection 102 may be customized according to shoe fit requirements or other appropriate applications as discussed herein. In some cases, the heel connection 102 may comprise threaded connections, adhesive bonding, mechanical fasteners, press-fit arrangements, or integrated molding configurations that enable secure attachment to different shoe constructions. The heel connection 102 may be adapted to accommodate various heel geometries, sole thicknesses, or material compositions commonly found in high-heeled footwear. In some aspects, the heel connection 102 may include adjustable features that allow modification of the attachment interface to suit specific shoe dimensions or mounting requirements. The heel connection 102 may be formed from materials compatible with shoe construction materials and may include surface treatments or coatings that enhance bonding characteristics or provide aesthetic coordination with the footwear design.

With continued reference to FIG. 1, a top post 104 may extend downward from the heel connection 102. The top post 104 may be configured to provide structural connection between the heel connection 102 and other components of the heel stabilizer apparatus 100. In some cases, the top post 104 may serve as a mounting point for internal mechanisms of the apparatus.

As further shown in FIGS. 1 and 2, the heel stabilizer apparatus 100 may include a shell 108 that extends longitudinally along the apparatus. The shell 108 may be configured to house internal components and may provide structural support for the overall mechanism. In some cases, the shell 108 may be formed from materials suitable for withstanding forces applied during use, such as ABS, titanium, or other durable polymeric materials.

Referring to FIG. 2, the shell 108 may include at least one slot 112 positioned in a sidewall of the shell 108. The slot 112 may be arranged near a lower portion of the shell 108 and may be configured to allow passage of deployable components. In some cases, multiple slots 112 may be provided at predetermined angular positions around the shell 108 to accommodate multiple deployable elements.

As shown in FIGS. 1 and 2, a shell foot pad 114 may be positioned at a base of the shell 108. The shell foot pad 114 may be configured to contact a ground surface and may provide traction and durability during use. In some cases, the shell foot pad 114 may be formed from materials selected for their wear resistance and grip characteristics.

With reference to FIGS. 1 and 2, a leg 116 may be arranged within the heel stabilizer apparatus 100 and may be configured to extend through the slot 112. The leg 116 may be movably coupled to internal components of the apparatus to enable deployment and retraction based on applied forces. In some cases, multiple legs 116 may be provided to form a stabilizing base when deployed.

As further illustrated in FIGS. 1 and 2, the leg 116 may include a leg foot pad 118 positioned at an extending end of the leg 116. The leg foot pad 118 may be configured to contact a ground surface when the leg 116 is in a deployed position, thereby providing additional stability and support. In some cases, the leg foot pad 118 may be formed from materials that provide durability and traction on various ground surfaces.

Figure 5A:
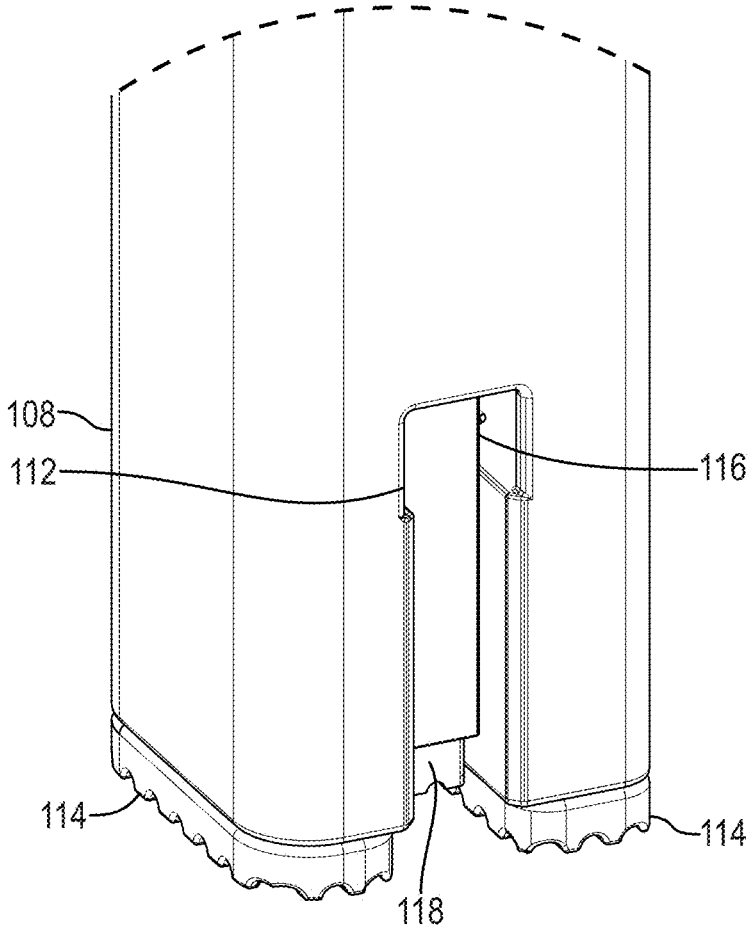
FIG. 5A depicts a portion of the heel stabilizer apparatus showing a shell and leg, according to aspects of the present disclosure.

Referring to FIG. 5A, the shell 108 may comprise a base that provides structural foundation for the heel stabilizer apparatus 100. The base of the shell 108 may be configured to support internal components and may provide a mounting surface for various elements of the apparatus. In some cases, the base may be formed integrally with sidewalls of the shell 108 to create a unitary housing structure.

Figure 3:
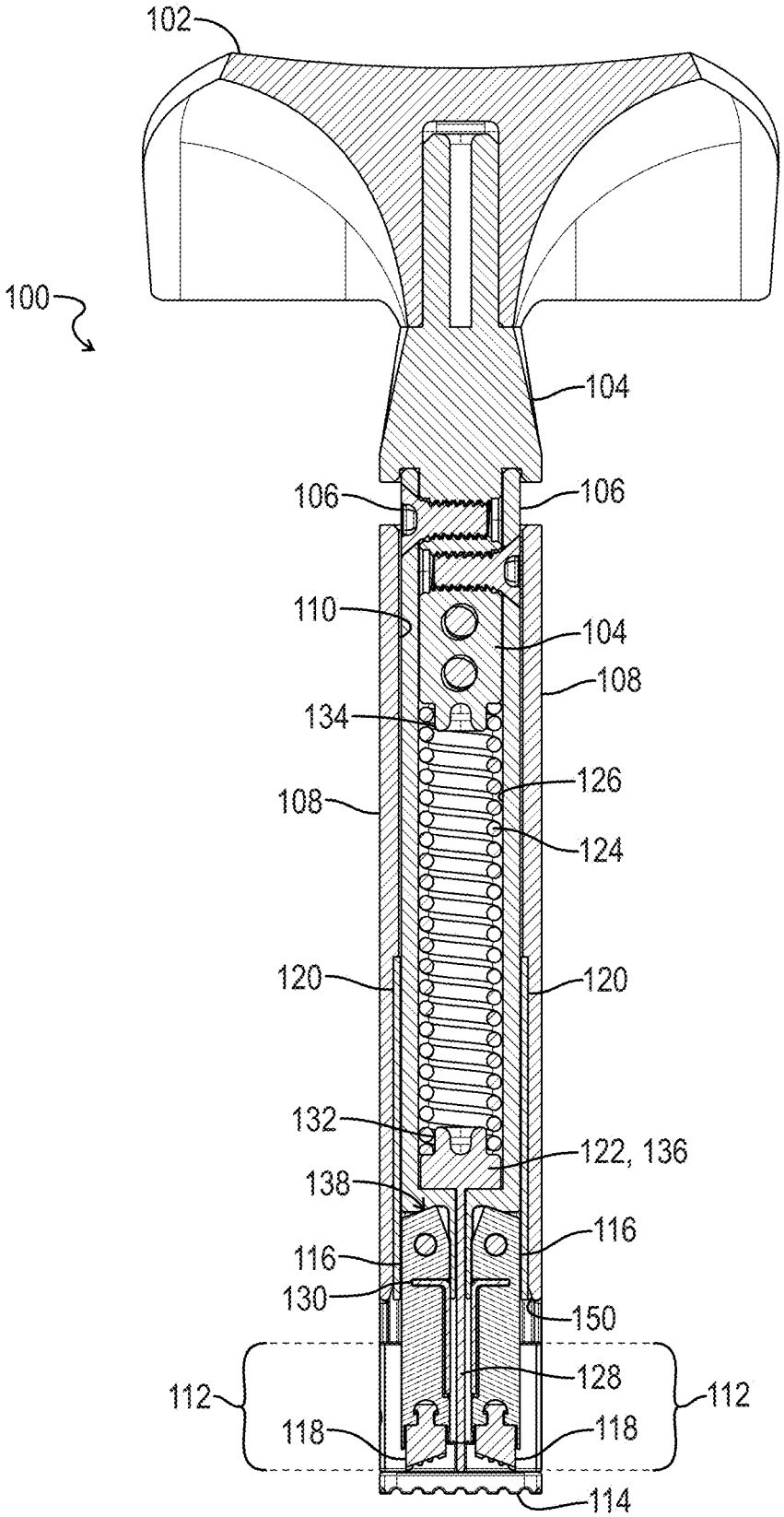
FIG. 3 shows a sectional view of the heel stabilizer apparatus of FIG. 1, according to aspects of the present disclosure.

As shown in FIG. 3, the shell 108 may comprise a shell bore 110 forming an interior surface of the shell 108. The shell bore 110 may extend longitudinally through the shell 108 and may be configured to accommodate movable components within the apparatus. In some cases, the shell bore 110 may have a cylindrical configuration with dimensions selected to allow controlled movement of internal elements while maintaining structural integrity of the shell 108.

With continued reference to FIG. 3, the shell 108 may include a teflon pad 120 positioned along the interior surface formed by the shell bore 110. The teflon pad 120 may be configured to reduce friction between moving components within the shell bore 110 and may facilitate smooth operation of the apparatus. In some cases, the teflon pad 120 may be arranged at predetermined locations along the length of the shell bore 110 to provide lubrication where contact between components occurs.

As further illustrated in FIG. 3, the shell bore 110 may comprise a shell bore chamfer 150 adjacent the at least one slot 112. The shell bore chamfer 150 may provide a transitional surface between the interior of the shell bore 110 and the slot 112, and may facilitate movement of components through the slot 112. In some cases, the shell bore chamfer 150 may be angled to guide deployable elements during their movement between retracted and extended positions.

Figure 5B:
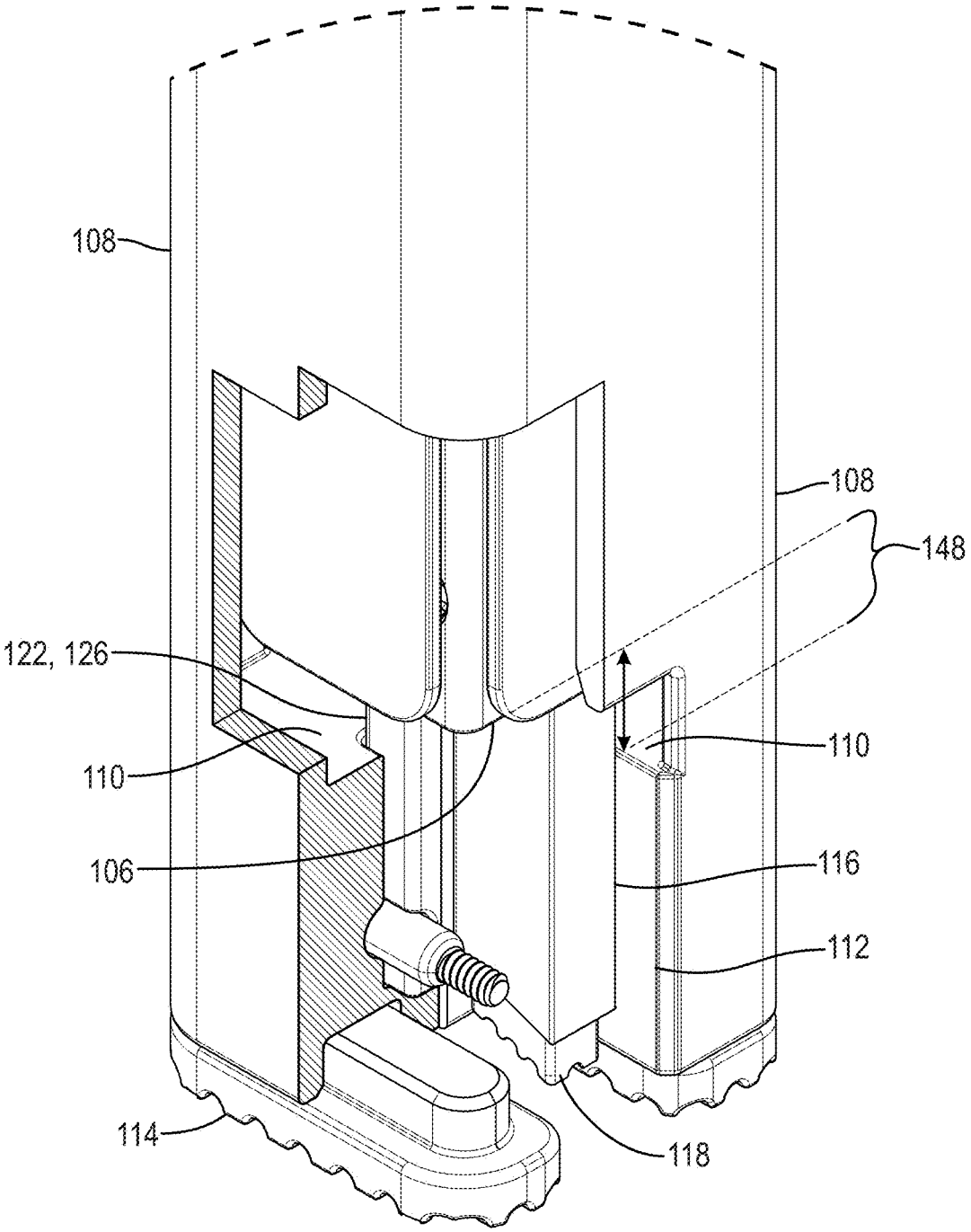
FIG. 5B shows a sectional view of the heel stabilizer apparatus illustrating shell travel, according to aspects of the present disclosure.

Referring to FIG. 5B, the at least one slot 112 may be arranged in a sidewall of the shell 108 and may extend through the wall thickness to provide an opening for component deployment. The slot 112 may have dimensions configured to accommodate passage of the leg 116 while maintaining structural integrity of the shell 108. In some cases, the slot 112 may have a rectangular or elongated configuration with width and height selected based on the cross-sectional dimensions of components intended to pass through the opening.

As shown in FIGS. 5A and 5B, the shell foot pad 114 may be configured to contact a ground surface and may provide a stable base for the heel stabilizer apparatus 100 when in use. The shell foot pad 114 may be positioned at the base of the shell 108 and may extend outwardly to provide a contact area with the ground. In some cases, the shell foot pad 114 may be formed from materials selected for durability and traction characteristics, and may have surface texturing or patterns to enhance grip on various ground surfaces.

Figure 4:
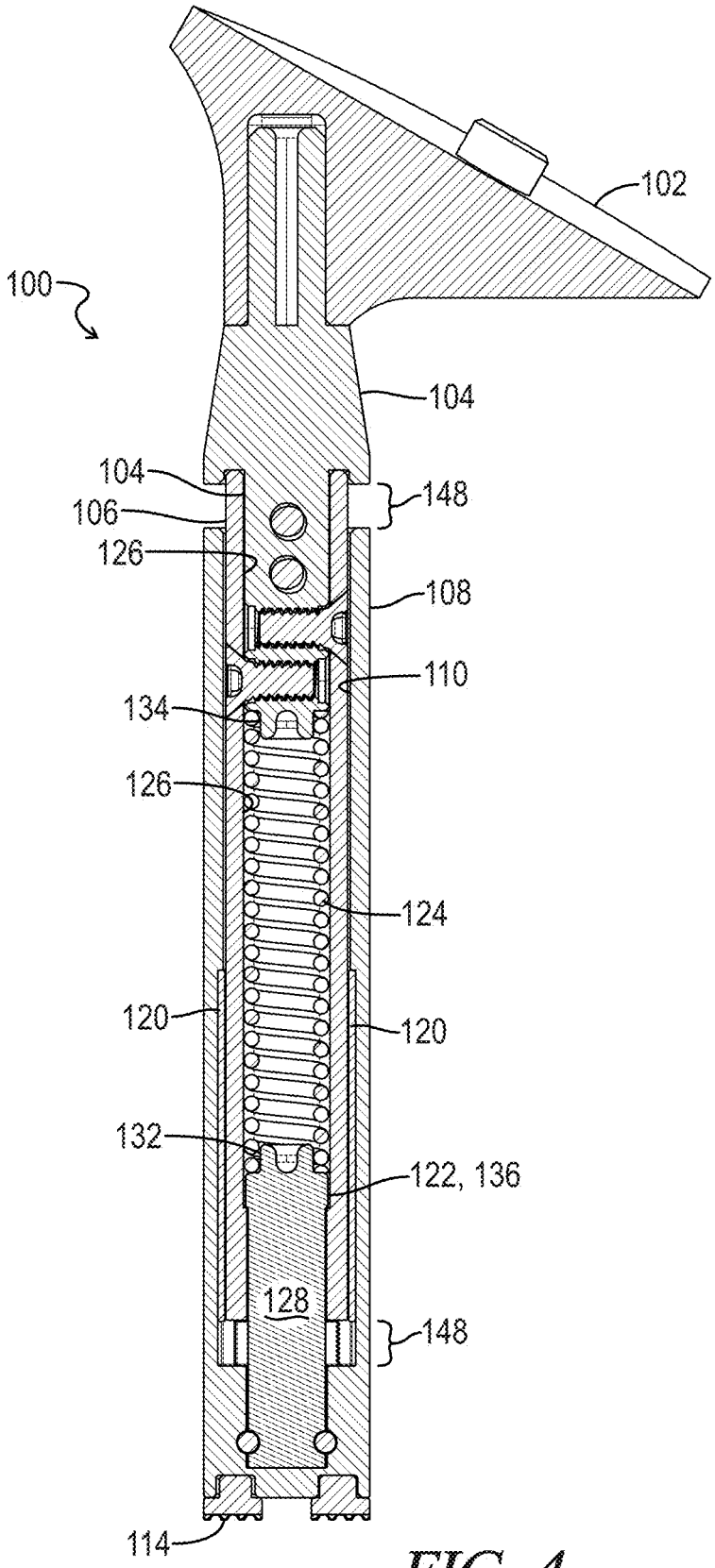
FIG. 4 illustrates a sectional view of the heel stabilizer apparatus of FIG. 1, according to aspects of the present disclosure.

Referring to FIG. 4, a rod 106 may be movably arranged relative to the shell 108 within the heel stabilizer apparatus 100. The rod 106 may extend longitudinally within the shell bore 110 and may be configured to move in a sliding relationship with the shell 108. In some cases, the rod 106 may be formed from materials providing structural strength and durability, such as stainless steel or aluminum alloys, and may have a cylindrical configuration with dimensions selected to fit within the shell bore 110 while allowing controlled movement.

As shown in FIG. 4, the rod 106 may comprise a rod bore 126 extending through at least a portion of the rod 106. The rod bore 126 may provide an internal cavity within the rod 106 and may be configured to accommodate other components of the heel stabilizer apparatus 100. In some cases, the rod bore 126 may extend longitudinally through the rod 106 and may have a cylindrical configuration with dimensions selected based on components intended to be housed within the cavity.

With continued reference to FIG. 4, the top post 104 may extend from an upper portion of the rod 106 and may provide structural connection between the rod 106 and the heel connection 102. The top post 104 may be formed integrally with the rod 106 or may be attached as a separate component. In some cases, the top post 104 may have a cylindrical or other geometric configuration and may be dimensioned to provide adequate structural support for forces transmitted through the heel stabilizer apparatus 100.

Figure 6:
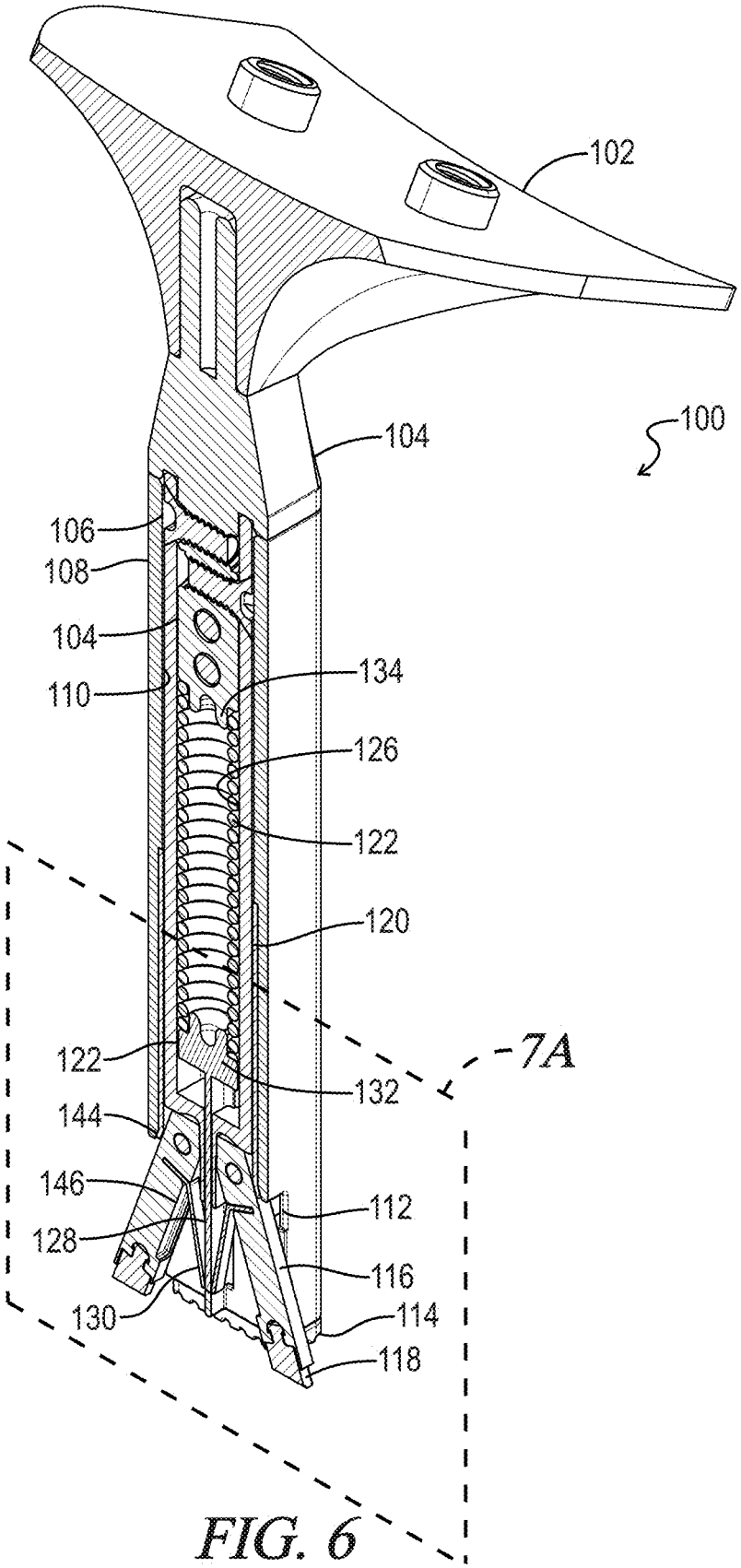
FIG. 6 illustrates a sectional view of the heel stabilizer apparatus of FIG. 1, according to aspects of the present disclosure.

As further illustrated in FIG. 6, the rod 106 may comprise a top post seat 134 configured to engage with other components of the apparatus. The top post seat 134 may be positioned on or within the top post 104 and may provide a contact surface or mounting location for additional elements. In some cases, the top post seat 134 may have a recessed or contoured configuration designed to accommodate specific components and may facilitate proper alignment and engagement during assembly and operation.

Figure 7A:
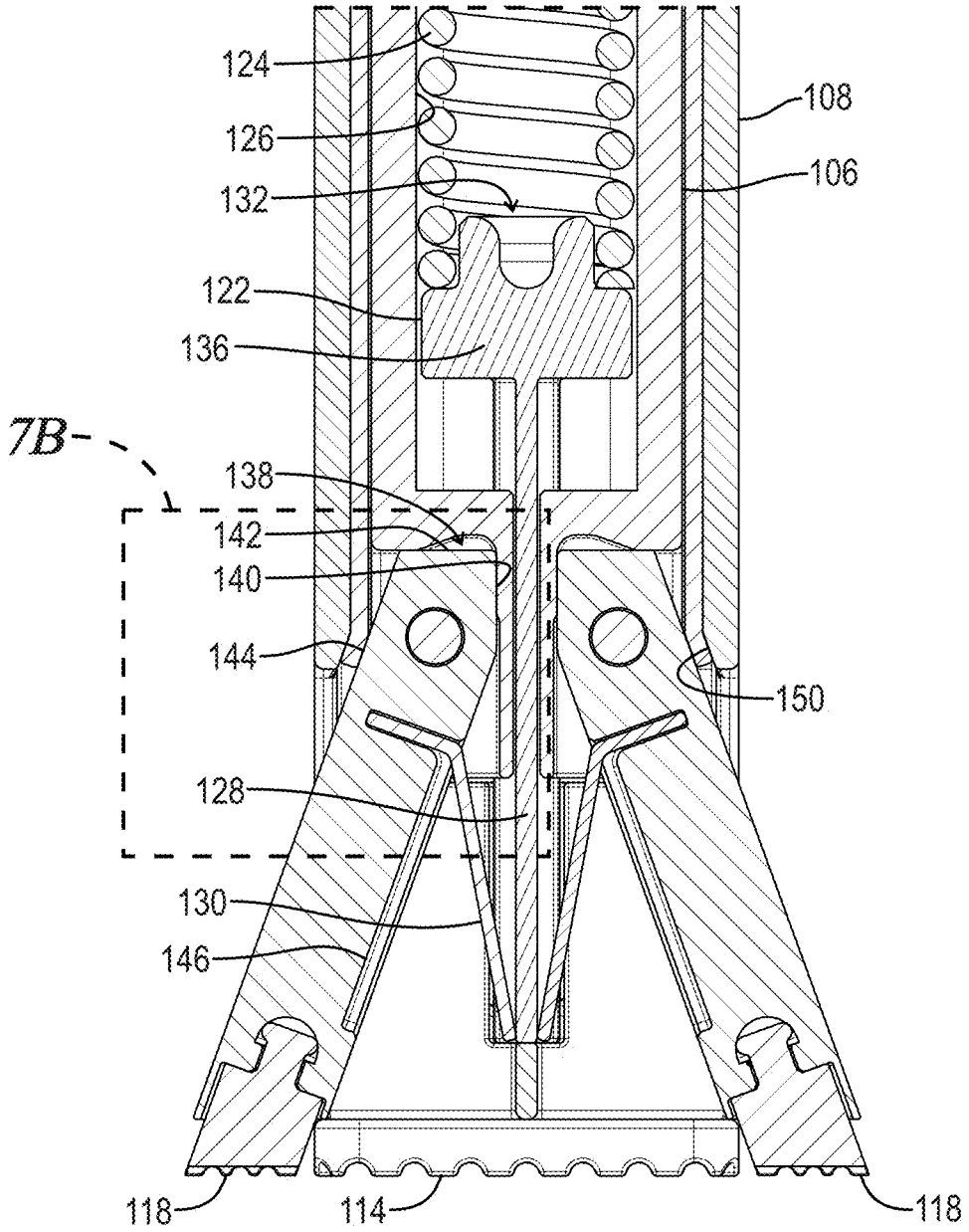
FIG. 7A depicts a sectional view of the heel stabilizer apparatus showing internal components, according to aspects of the present disclosure.

Referring to FIG. 7A, the rod 106 may be configured to interact with the shell 108 to enable relative movement between a first position and a second position. The movable arrangement between the rod 106 and the shell 108 may allow the shell 108 to translate along the rod 106 in response to applied forces. In some cases, the relative movement may be guided by the engagement between the rod 106 and the shell bore 110, with the teflon pad 120 facilitating smooth sliding motion between the components.

As shown in FIG. 6, the rod 106 may be positioned within the shell bore 110 such that the rod 106 may move longitudinally relative to the shell 108 while maintaining alignment and structural integrity of the heel stabilizer apparatus 100. The movable arrangement may allow the shell 108 to compress toward the rod 106 when force is applied to the apparatus, thereby enabling deployment of stabilizing elements through the slot 112. In some cases, the range of movement between the first position and the second position may be controlled by dimensional relationships between the rod 106, the shell 108, and other components of the apparatus. Referring to FIGS. 1 and 2, a bottom surface of at least a portion of the top post 104 may form a stop surface to prevent further movement of the shell 108 relative to the rod 106. The stop surface may be positioned to engage with corresponding surfaces of the shell 108 when the apparatus reaches the second position, thereby limiting the range of relative movement between components. In some cases, the stop surface may provide mechanical constraint that prevents over-compression of internal components and may ensure proper positioning of deployable elements during operation of the heel stabilizer apparatus 100.

Figure 8:
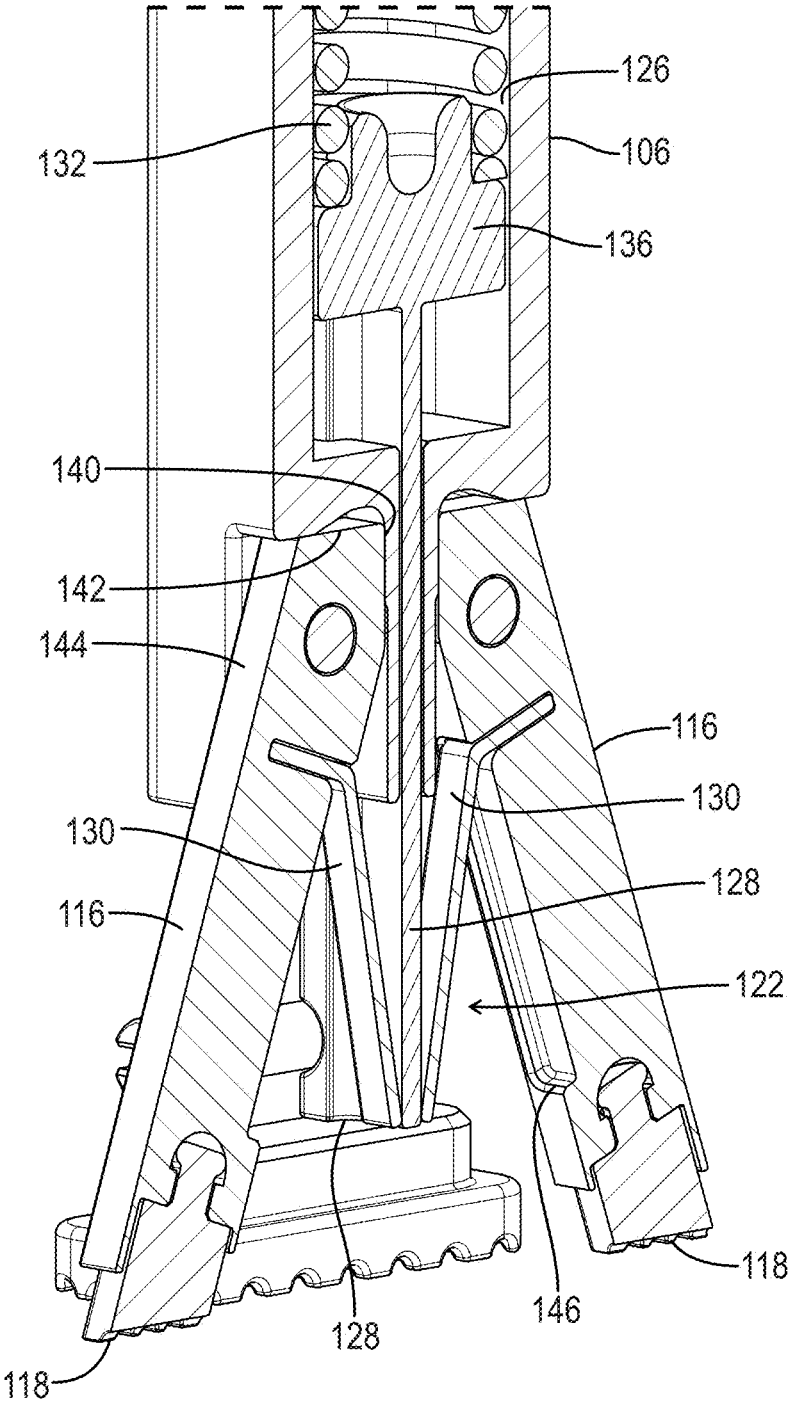
FIG. 8 shows a sectional view of the heel stabilizer apparatus illustrating leg components, according to aspects of the present disclosure.

Referring to FIG. 8, a compression post 122 may be coupled to the shell 108 within the heel stabilizer apparatus 100. The compression post 122 may be positioned within the shell bore 110 and may provide structural support for various components of the apparatus. In some cases, the compression post 122 may be formed from materials selected for structural integrity and may be configured to withstand forces applied during operation of the heel stabilizer apparatus 100.

As shown in FIG. 8, the compression post 122 may comprise a compression post wall 128 that defines an outer surface of the compression post 122. The compression post wall 128 may extend longitudinally within the shell bore 110 and may provide a structural boundary for internal components. In some cases, the compression post wall 128 may have a rectangular cross-section configuration configured to delimit areas for housing the legs and may be dimensioned to fit within the shell bore 110 while providing adequate wall thickness for structural support.

With continued reference to FIG. 8, the compression post 122 may include a compression post base 136. The compression post base 136 may provide a foundation for the compression post 122 within the shell 108 and may serve as a mounting or contact surface for other components. In some cases, the compression post base 136 may be formed integrally with the compression post wall 128 or may be attached as a separate component to provide a stable base structure.

As further illustrated in FIG. 8, the compression post 122 may comprise a compression post seat 132 configured to engage with resilient elements of the heel stabilizer apparatus 100. The compression post seat 132 may be positioned on or within the compression post 122 and may provide a contact surface or mounting location for springs or other biasing elements. In some cases, the compression post seat 132 may have a recessed or contoured configuration designed to accommodate specific components and may facilitate proper alignment during assembly and operation.

Referring to FIG. 7A, the compression post 122 may be positioned and secured within the shell bore 110 to provide structural support and component interaction surfaces. The compression post 122 may be coupled to the shell 108 through various attachment methods, such as press-fitting, threading, or adhesive bonding. In some cases, the compression post 122 may be fixed relative to the shell 108 such that the compression post 122 moves with the shell 108 during relative motion between the shell 108 and the rod 106.

As shown in FIG. 7A, the compression post wall 128 may provide a barrier or surface between deployable components within the heel stabilizer apparatus 100. The compression post wall 128 may interact with legs or other movable elements to control their positioning and movement during operation. In some cases, the compression post wall 128 may serve as a guide surface or contact boundary that influences the deployment characteristics of stabilizing elements.

With continued reference to FIG. 7A, the compression post base 136 may be positioned at a lower portion of the shell bore 110 and may provide a stable foundation for the compression post 122. The compression post base 136 may be configured to distribute loads applied to the compression post 122 and may provide structural continuity between the compression post 122 and the shell 108. In some cases, the compression post base 136 may extend across a cross-sectional area of the shell bore 110 to provide adequate support for forces transmitted through the apparatus.

A resilient element 124 may be arranged between the rod 106 and the shell 108 within the heel stabilizer apparatus 100. The resilient element 124 may be configured to provide biasing force that influences the relative positioning of the rod 106 and the shell 108 during operation of the apparatus. In some cases, the resilient element 124 may be positioned to create a spring-loaded relationship between components that enables controlled movement in response to applied forces.

The resilient element 124 may be configured to bias the rod 106 and the shell 108 to a first position. In the first position, the resilient element 124 may maintain the rod 106 and the shell 108 in a predetermined spatial relationship that corresponds to a retracted state of deployable components. In some cases, the biasing force provided by the resilient element 124 may be overcome by external forces applied to the heel stabilizer apparatus 100, allowing movement to a second position where stabilizing elements may be deployed.

The resilient element 124 may be arranged in the rod bore 126 to provide a compact and protected configuration within the heel stabilizer apparatus 100. The positioning of the resilient element 124 within the rod bore 126 may allow the resilient element 124 to operate in compression or tension while being contained within the structural boundaries of the rod 106. In some cases, the rod bore 126 may provide dimensional constraints that guide the operation of the resilient element 124 and may protect the resilient element 124 from external environmental factors.

In an exemplary aspect, the resilient element 124 may comprise a helical spring configured to provide controlled biasing force between the rod 106 and the shell 108. The helical spring configuration may provide predictable force characteristics and may be selected based on desired spring rate and compression or extension requirements. In some cases, the helical spring may be formed from materials such as steel alloys or other spring materials that provide durability and consistent performance over repeated loading cycles. The helical spring may be configured with variable pitch characteristics to provide non-linear force response during compression or extension. A variable pitch configuration may include tighter coil spacing at one end and wider spacing at the other end, thereby providing progressive spring rate characteristics that offer softer initial compression followed by increased resistance as compression increases. In some cases, the variable pitch design may enable more controlled deployment characteristics by providing different force levels at different stages of the compression cycle.

The resilient element 124 may alternatively comprise a conical spring configuration where the coil diameter varies along the length of the spring. The conical spring may provide space-saving characteristics when compressed, as smaller diameter coils may nest within larger diameter coils. In some cases, the conical spring configuration may offer progressive spring rate characteristics while occupying less space in the compressed state compared to conventional cylindrical helical springs.

The resilient element 124 may comprise multiple helical springs arranged in series to provide combined spring characteristics. The series arrangement may include springs with different spring rates or materials to achieve desired force-displacement characteristics that may not be achievable with a single spring. In some cases, the series arrangement may provide redundancy such that if one spring fails, the remaining springs continue to provide biasing force for the heel stabilizer apparatus.

The resilient element 124 may alternatively comprise multiple helical springs arranged in parallel to provide increased force capacity or redundancy. The parallel arrangement may distribute the applied load across multiple springs, thereby reducing stress on individual springs and potentially extending service life. In some cases, the parallel arrangement may enable the use of smaller individual springs while achieving the same total force capacity as a single larger spring.

The helical spring may be formed from superelastic materials such as nitinol or other shape memory alloys that provide enhanced fatigue resistance and temperature stability. Superelastic materials may maintain consistent spring characteristics over a wider temperature range compared to conventional spring steels and may provide superior resistance to permanent deformation under repeated loading. In some cases, the superelastic properties may enable the spring to return to its original shape even after significant deformation, thereby providing enhanced durability for the heel stabilizer apparatus.

The resilient element 124 may comprise a composite spring structure that combines metallic spring elements with elastomeric components. The composite structure may include a helical metal spring core surrounded by or integrated with elastomeric material to provide damping characteristics in addition to spring force. In some cases, the elastomeric component may reduce vibration transmission and provide smoother operation during deployment and retraction cycles.

The helical spring may be manufactured with surface treatments such as shot peening, stress relieving, or coating applications to enhance fatigue life and corrosion resistance. Shot peening may introduce compressive residual stresses in the surface layers of the spring material, thereby improving resistance to fatigue crack initiation. In some cases, protective coatings such as zinc plating, powder coating, or polymer coatings may provide corrosion protection while maintaining spring performance characteristics.

The resilient element 124 may be configured with adjustable preload characteristics through the use of threaded adjustment mechanisms or spacer elements. The adjustable preload may enable customization of the force required to initiate deployment of the heel stabilizer apparatus based on user weight or preference. In some cases, the adjustment mechanism may include threaded components that allow modification of the initial compression of the spring, thereby changing the force threshold for activation.

The helical spring may incorporate end configurations such as closed and ground ends, open ends, or specialized end shapes to optimize force transmission and seating characteristics. Closed and ground ends may provide flat bearing surfaces that distribute loads evenly and prevent stress concentrations at the spring ends. In some cases, specialized end configurations may include hooks, loops, or threaded attachments that facilitate connection to other components of the heel stabilizer apparatus.

The resilient element 124 may alternatively comprise a pneumatic arrangement that utilizes compressed air to provide biasing force between the rod 106 and the shell 108. The pneumatic arrangement may include a cylinder and piston configuration where compressed air within the cylinder provides the restoring force to return the apparatus to the first position. In some cases, the pneumatic system may include adjustable pressure settings that allow customization of the biasing force based on user requirements or operating conditions.

The pneumatic arrangement may include a sealed air chamber positioned within the rod bore 126 or between the rod 106 and the shell 108. The air chamber may be pre-pressurized during manufacturing to provide a predetermined biasing force that maintains the apparatus in the first position under normal conditions. In some cases, the pneumatic system may include a pressure relief valve or adjustment mechanism that enables modification of the internal pressure to alter the deployment characteristics of the heel stabilizer apparatus.

The resilient element 124 may comprise a hydraulic arrangement that utilizes fluid pressure to provide controlled biasing force and damping characteristics. The hydraulic arrangement may include a fluid-filled cylinder with a movable piston that responds to applied forces while providing resistance through fluid displacement. In some cases, the hydraulic system may include viscous fluid that provides both spring-like restoring force and damping to control the rate of deployment and retraction.

The hydraulic arrangement may incorporate a fluid reservoir and flow control mechanisms to regulate the movement characteristics of the heel stabilizer apparatus. The flow control may include orifices or valves that restrict fluid movement to provide controlled deployment speed and prevent rapid or jarring transitions between positions. In some cases, the hydraulic system may include different flow rates for deployment and retraction to optimize the operational characteristics for user comfort and stability.

The resilient element 124 may alternatively comprise an elastomeric element formed from natural or synthetic rubber materials. The elastomeric element may be configured as a solid rubber block, cylinder, or other geometric shape that provides biasing force through elastic deformation. In some cases, the rubber element may be formulated with specific durometer characteristics to provide desired force-displacement relationships while maintaining durability over repeated compression cycles.

The elastomeric element may comprise a rubber stopper or bumper positioned between the rod 106 and the shell 108 to provide cushioned biasing force. The rubber stopper may be formed from materials such as neoprene, silicone rubber, or polyurethane that provide consistent elastic properties and resistance to environmental factors. In some cases, the rubber stopper may include internal voids or hollow sections that modify the compression characteristics and provide progressive force response during loading.

The resilient element 124 may comprise a foam element formed from polyurethane, polyethylene, or other cellular materials that provide compressive resistance through cell structure deformation. The foam element may offer lightweight characteristics while providing adequate biasing force for the heel stabilizer apparatus operation. In some cases, the foam density and cell structure may be selected to provide specific force-displacement characteristics that complement the deployment requirements of the apparatus.

The resilient element 124 may alternatively comprise a gas-filled bladder or balloon arrangement that provides biasing force through internal gas pressure. The gas-filled bladder may be positioned between the rod 106 and the shell 108 and may be pre-pressurized with air, nitrogen, or other suitable gases. In some cases, the bladder material may be selected for durability and gas retention properties, and may include reinforcement layers to prevent puncture or failure during operation.

The resilient element 124 may comprise a magnetic arrangement that utilizes magnetic repulsion or attraction forces to provide biasing characteristics. The magnetic arrangement may include permanent magnets or electromagnets positioned to create repulsive forces that maintain the apparatus in the first position. In some cases, the magnetic system may include rare earth magnets that provide strong magnetic fields in a compact configuration, enabling effective biasing force while occupying minimal space within the apparatus.

The magnetic arrangement may incorporate adjustable magnetic elements that allow modification of the biasing force through repositioning or reorientation of magnetic components. The adjustable configuration may enable customization of the deployment characteristics based on user preferences or specific application requirements. In some cases, the magnetic system may include electromagnetic components that allow electronic control of the biasing force through applied current or voltage.

The resilient element 124 may alternatively comprise a torsional element that provides biasing force through rotational elastic deformation. The torsional element may include a twisted rod, cable, or other structural member that stores energy through angular displacement and provides restoring torque to return the apparatus to the first position. In some cases, the torsional element may be configured to convert rotational motion to linear motion through cam mechanisms or threaded interfaces.

The resilient element 124 may comprise a composite arrangement that combines multiple biasing technologies to provide enhanced performance characteristics. The composite arrangement may include combinations of pneumatic and elastomeric elements, hydraulic and magnetic systems, or other hybrid configurations that leverage the advantages of different biasing mechanisms. In some cases, the composite system may provide redundancy such that if one biasing mechanism fails, alternative mechanisms continue to provide restoring force for the heel stabilizer apparatus.

The resilient element 124 may be arranged between the top post 104 and the compression post 122 to create a biasing relationship between these components. The positioning between the top post 104 and the compression post 122 may allow the resilient element 124 to influence the relative movement of the rod 106 and the shell 108 by applying force between components that are respectively associated with these structures. In some cases, the arrangement may provide a direct load path for biasing forces while maintaining proper alignment of components during operation.

The resilient element 124 may engage with the top post seat 134 and the compression post seat 132 to provide proper positioning and force transmission. The top post seat 134 may provide a contact surface or mounting location for one end of the resilient element 124, while the compression post seat 132 may provide a corresponding contact surface for an opposite end of the resilient element 124. In some cases, the top post seat 134 and the compression post seat 132 may have contoured or recessed configurations that accommodate the geometry of the resilient element 124 and may prevent lateral displacement during compression or extension cycles.

The resilient element 124 may enable relative movement between the rod 106 and the shell 108 under applied force while providing a restoring force that returns the components to the first position when the applied force is removed. When force is applied to the heel stabilizer apparatus 100, the resilient element 124 may compress or extend to allow the shell 108 to move relative to the rod 106, thereby enabling deployment of stabilizing components. In some cases, the spring characteristics of the resilient element 124 may be selected to provide appropriate force thresholds for deployment while ensuring reliable return to the retracted position when external forces are removed.

Figure 9:
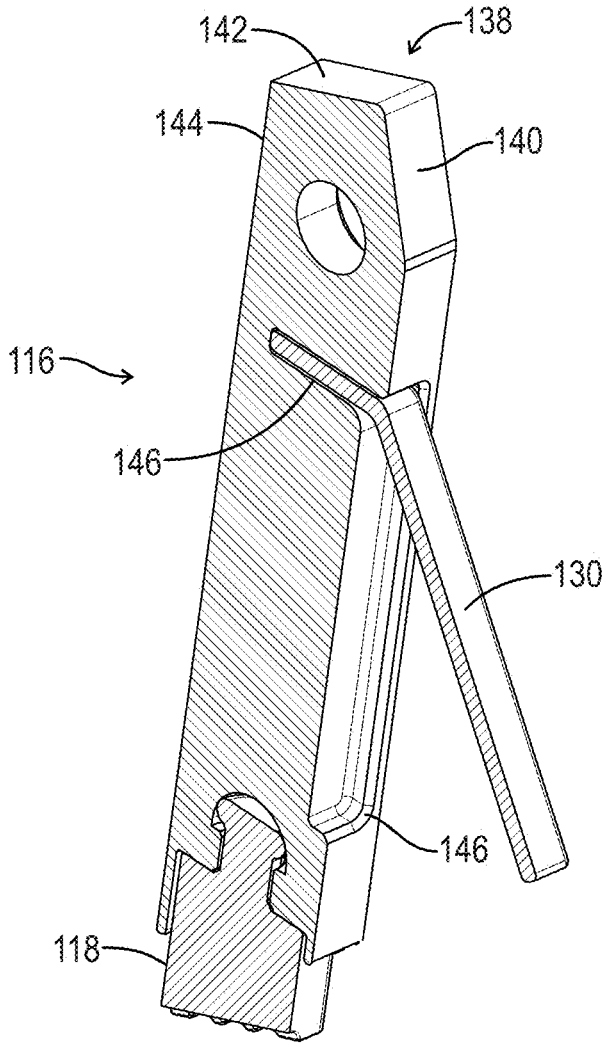
FIG. 9 illustrates an isometric view of a leg for the heel stabilizer apparatus, according to aspects of the present disclosure.

Referring to FIG. 9, the leg 116 may be movably coupled to the rod 106 to enable controlled deployment and retraction within the heel stabilizer apparatus 100. The movable coupling between the leg 116 and the rod 106 may allow the leg 116 to respond to relative movement between the rod 106 and the shell 108, thereby facilitating extension of the leg 116 through the slot 112 when the apparatus transitions from the first position to the second position.

As shown in FIGS. 8 and 9, the leg 116 may comprise a leg interior groove 146 formed within a structure of the leg 116. The leg interior groove 146 may extend along at least a portion of the leg 116 and may be configured to accommodate resilient elements or other components that influence movement of the leg 116. In some cases, the leg interior groove 146 may have a recessed configuration that provides space for springs or biasing elements while maintaining structural integrity of the leg 116.

With continued reference to FIGS. 8 and 9, the leg 116 may comprise a leg exterior contact surface 144 configured to interact with surfaces within the heel stabilizer apparatus 100 during operation. The leg exterior contact surface 144 may be positioned on an outer portion of the leg 116 and may be configured to contact the shell bore 110 in the first position. In some cases, the leg exterior contact surface 144 may provide a sliding interface that allows controlled movement of the leg 116 relative to the shell 108 while maintaining proper alignment and positioning.

As further illustrated in FIG. 9, the leg exterior contact surface 144 may be configured to contact the shell bore chamfer 150 in the second position. The interaction between the leg exterior contact surface 144 and the shell bore chamfer 150 may facilitate smooth transition of the leg 116 through the slot 112 during deployment. In some cases, the leg exterior contact surface 144 may have surface characteristics or geometry that complement the shell bore chamfer 150 to enable controlled movement while minimizing friction and wear.

Referring to FIG. 9, the leg 116 may comprise a faceted top surface that provides multiple contact interfaces for interaction with other components of the heel stabilizer apparatus 100. The faceted top surface may include angular or contoured regions that enable the leg 116 to engage with different surfaces during movement between the first position and the second position. In some cases, the faceted configuration may provide controlled contact points that influence the deployment characteristics and positioning of the leg 116.

As shown in FIG. 9, the faceted top surface may comprise a leg angled top surface 138 that provides a transitional interface between different portions of the leg 116. The leg angled top surface 138 may be oriented at a predetermined angle relative to other surfaces of the leg 116 and may facilitate interaction with components during movement of the leg 116. In some cases, the leg angled top surface 138 may provide a cam-like interface that influences the deployment path of the leg 116 as the apparatus transitions between positions.

With continued reference to FIG. 9, the faceted top surface may comprise a leg top interior contact surface 142 and a leg side interior contact surface 140. The leg top interior contact surface 142 may serve as a top contact surface configured to contact a bottom surface of the rod 106 in the second position. The leg side interior contact surface 140 may serve as a side contact surface configured to contact the compression post 122 in the second position. In some cases, these contact surfaces may provide controlled engagement points that limit movement of the leg 116 and may establish predetermined positioning when the heel stabilizer apparatus 100 is in the deployed configuration.

As further illustrated in FIG. 9, the leg top interior contact surface 142 may be positioned to engage with the rod 106 when the apparatus reaches the second position, thereby providing a mechanical stop or limit for the deployment movement. The contact between the leg top interior contact surface 142 and the bottom surface of the rod 106 may prevent over-extension of the leg 116 and may ensure proper positioning for stability enhancement. In some cases, the leg top interior contact surface 142 may have surface characteristics that provide controlled engagement while minimizing wear during repeated contact cycles.

The leg side interior contact surface 140 may be configured to engage with the compression post 122 in the second position to provide lateral positioning and stability for the leg 116. The contact between the leg side interior contact surface 140 and the compression post 122 may control the angular orientation of the leg 116 during deployment and may prevent unwanted rotation or misalignment. In some cases, the leg side interior contact surface 140 may work in conjunction with the leg top interior contact surface 142 to establish a stable deployed configuration for the leg 116.

Figure 7B:
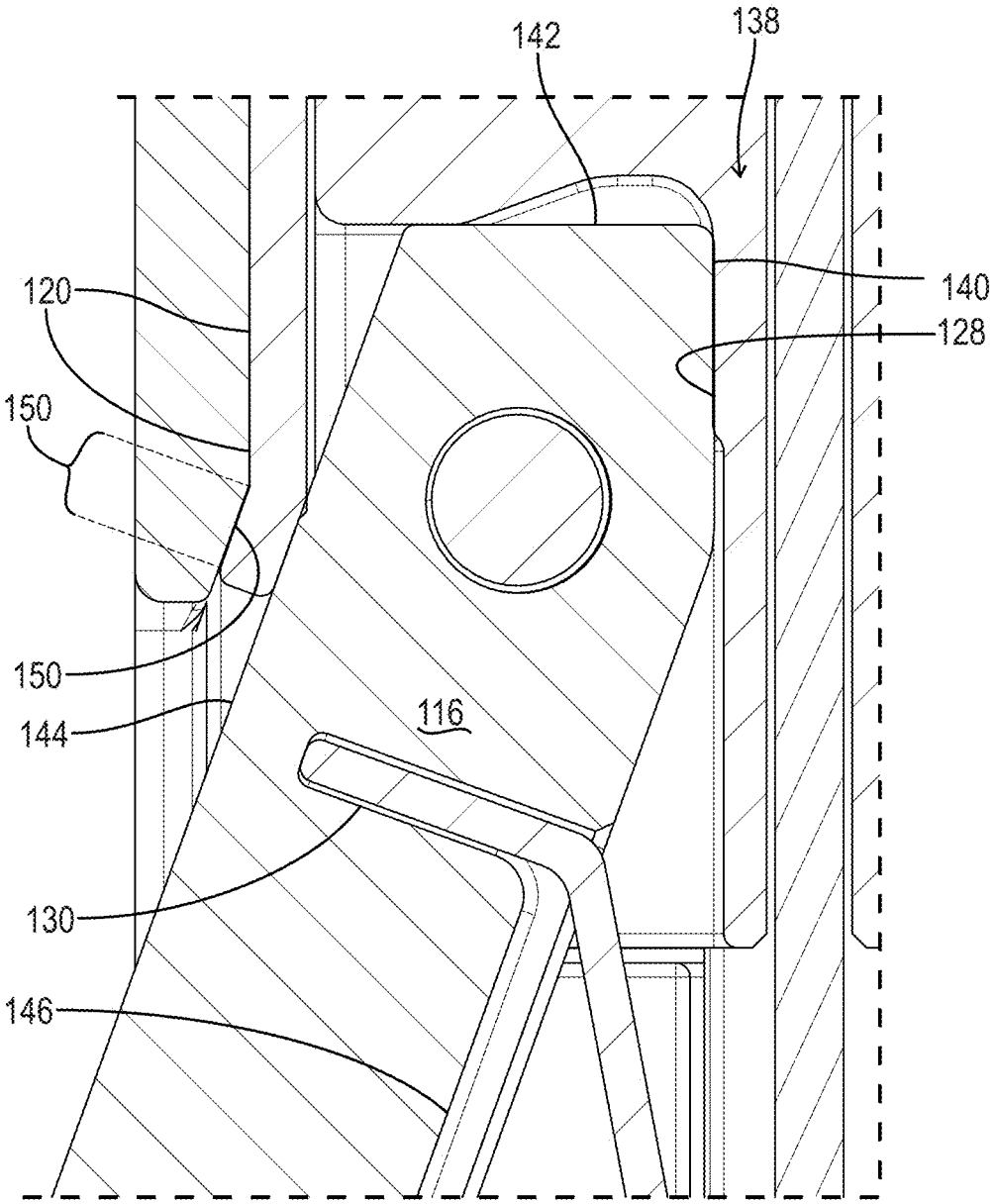
FIG. 7B shows a sectional view of the heel stabilizer apparatus illustrating detailed internal component relationships, according to aspects of the present disclosure.

Referring to FIG. 7B, the heel stabilizer apparatus 100 may be illustrated in a magnified sectional view that provides enhanced detail of the internal component relationships and spatial arrangements within the apparatus. FIG. 7B may show the heel stabilizer apparatus 100 with the heel connection 102 positioned at an upper portion, with the top post 104 extending downward to connect with the rod 106. The rod 106 may be arranged within the shell 108, which may include the shell bore 110 forming an interior surface and the slot 112 positioned in a sidewall of the shell 108.

As shown in FIG. 7B, the compression post 122 may be positioned within the shell 108 and may include the compression post wall 128, the compression post base 136, and the compression post seat 132. The leg 116 may be positioned within the apparatus and may include the leg foot pad 118 at an extending end. The leg 116 may comprise the leg angled top surface 138, the leg top interior contact surface 142, the leg side interior contact surface 140, the leg exterior contact surface 144, and the leg interior groove 146. The leg resilient element 130 may be positioned adjacent to the leg 116 and may be configured to bias the leg 116 toward deployment through the slot 112.

As further illustrated in FIG. 7B, the shell bore chamfer 150 may be positioned adjacent the slot 112 to provide a transitional surface that facilitates movement of the leg 116 during deployment. In some cases, the magnified view provided by FIG. 7B may enable clear visualization of the precise spatial relationships between components that enable the deployment mechanism.

In the deployed position, the leg 116 may establish a three-point contact system that provides structural support and precise positioning within the heel stabilizer apparatus 100. The first contact point may be established where the leg exterior contact surface 144 engages with the shell bore chamfer 150, providing guidance and support for the leg 116 as it extends through the slot 112. In some cases, this contact point may control the deployment path of the leg 116 and may ensure proper alignment during the transition from the retracted state to the deployed state. The engagement between the leg exterior contact surface 144 and the shell bore chamfer 150 may be facilitated through force dispersing structures that provide enhanced contact characteristics and operational control. In some cases, an intermediary pad 120 may be positioned between the leg exterior contact surface 144 and the shell bore chamfer 150 to provide flexible interface properties that enhance the deployment mechanism. The intermediary pad 120 may comprise flexible materials that provide sealing and cushioning functions between the leg exterior contact surface 144 and the shell bore chamfer 150, thereby reducing wear and providing controlled contact forces during deployment and retraction cycles. The flexible characteristics of the intermediary pad 120 may allow for a certain degree of flexion in the leg 116 deployed position, with the extent of flexion being determined by the thickness and specific material properties of the pad 120. In some cases, the material selection and dimensional characteristics of the intermediary pad 120 may be configured to provide predetermined deployment angles or positioning tolerances that optimize the stability characteristics of the deployed leg 116 while accommodating variations in applied forces or ground surface conditions.

As shown in FIG. 7B, the second contact point may be formed where the leg top interior contact surface 142 contacts a bottom surface of the rod 106 or an associated component such as the compression post 122. This contact point may provide vertical positioning control for the leg 116 in the deployed configuration and may serve as a mechanical stop that prevents over-extension of the leg 116. In some cases, the leg top interior contact surface 142 may be positioned to engage when the apparatus reaches the second position, thereby establishing a predetermined deployed position that optimizes stability characteristics.

With continued reference to FIG. 7B, the third contact point may be created where the leg side interior contact surface 140 abuts the compression post wall 128 or another internal structural element. This lateral contact point may provide rotational stability for the leg 116 and may prevent unwanted angular displacement during deployment and use. In some cases, the leg side interior contact surface 140 may work in conjunction with the other contact points to establish a kinematically constrained deployed configuration that ensures consistent positioning of the leg 116 relative to other components of the heel stabilizer apparatus 100.

As further illustrated in FIG. 7B, the three-point contact system may work together to create a stable and precisely positioned deployed configuration that enhances the structural integrity of the heel stabilizer apparatus 100. The combination of the leg exterior contact surface 144 engaging the shell bore chamfer 150, the leg top interior contact surface 142 contacting the rod 106 or compression post 122, and the leg side interior contact surface 140 abutting the compression post wall 128 may provide comprehensive positioning control in multiple degrees of freedom. In some cases, this three-point contact arrangement may ensure that the leg 116 maintains proper orientation and positioning to provide reliable ground contact through the leg foot pad 118 while preventing unwanted movement or misalignment during use of the heel stabilizer apparatus 100.

Referring to FIG. 9, the leg foot pad 118 may be configured to contact a ground surface in the second position to provide enhanced stability for the heel stabilizer apparatus 100. The leg foot pad 118 may be positioned at an extending end of the leg 116 and may be formed from materials selected for durability and traction characteristics. In some cases, the leg foot pad 118 may extend outwardly from the leg 116 when deployed through the slot 112, thereby creating an expanded contact area with the ground surface that reduces pressure concentration and improves balance.

The structural features of the leg 116, including the leg interior groove 146, the leg exterior contact surface 144, and the faceted top surface with the leg angled top surface 138, the leg top interior contact surface 142, and the leg side interior contact surface 140, may work together to enable controlled movement of the leg 116 through the slot 112 during operation. The leg interior groove 146 may accommodate biasing elements that influence deployment, while the leg exterior contact surface 144 may provide sliding interfaces with the shell bore 110 and the shell bore chamfer 150. In some cases, the faceted top surface may provide multiple contact points that control positioning and limit movement during deployment and retraction cycles, thereby ensuring reliable operation of the heel stabilizer apparatus 100.

Referring to FIGS. 7A-8, in the deployed position, the leg 116 may establish three points of contact that provide structural support and positioning within the heel stabilizer apparatus 100. The leg exterior contact surface 144 may engage with the shell bore chamfer 150 to provide a first contact point that guides and supports the leg 116 during deployment through the slot 112. The leg top interior contact surface 142 may contact a bottom surface of the rod 106 or the compression post 122 to establish a second contact point that limits upward movement and provides vertical positioning of the leg 116 in the deployed configuration. The leg side interior contact surface 140 may abut the compression post wall 128 or a similar extension of another internal structure to create a third contact point that provides lateral stability and prevents unwanted rotation or misalignment of the leg 116. In some cases, these three points of contact may work together to establish a stable and precisely positioned deployed configuration that enhances the structural integrity of the heel stabilizer apparatus 100 while providing reliable ground contact through the leg foot pad 118.

A leg resilient element 130 may be coupled with the leg 116 within the heel stabilizer apparatus 100. The leg resilient element 130 may be configured to provide biasing force that influences the positioning and movement of the leg 116 during operation of the apparatus. In some cases, the leg resilient element 130 may be positioned to create a spring-loaded relationship that enables controlled deployment of the leg 116 through the slot 112.

The leg resilient element 130 may be configured to bias the leg 116 to protrude through the slot 112. The biasing force provided by the leg resilient element 130 may urge the leg 116 toward an extended position where the leg 116 extends through the slot 112 to provide enhanced stability for the heel stabilizer apparatus 100. In some cases, the leg resilient element 130 may work in conjunction with the relative movement between the rod 106 and the shell 108 to enable controlled deployment of the leg 116 when the apparatus transitions from the first position to the second position.

The leg resilient element 130 may comprise a spring positioned between the leg 116 and at least a portion of the compression post 122. The positioning of the spring between the leg 116 and the compression post 122 may create a biasing relationship that influences the movement of the leg 116 relative to other components of the heel stabilizer apparatus 100. In some cases, the spring may be compressed when the leg 116 is in a retracted position and may expand to urge the leg 116 toward deployment when conditions allow movement through the slot 112.

The leg resilient element 130 may be configured according to any of the resilient element structures previously disclosed for the resilient element 124, including helical springs with variable pitch or conical configurations, multiple springs arranged in series or parallel, superelastic materials such as nitinol, composite spring structures combining metallic and elastomeric components, pneumatic arrangements utilizing compressed air, hydraulic arrangements with fluid pressure and damping characteristics, elastomeric elements formed from rubber materials, foam elements with cellular structure, gas-filled bladders, magnetic arrangements using repulsion or attraction forces, torsional elements providing rotational elastic deformation, or composite arrangements combining multiple biasing technologies. In some cases, the leg resilient element 130 may be configured to bias the leg 116 toward either a deployed position where the leg 116 protrudes through the slot 112 or alternatively toward a retracted position where the leg 116 remains within the envelope of the shell 108, depending on the specific application requirements and desired operational characteristics of the heel stabilizer apparatus 100.

The spring may comprise a leaf spring configured to provide controlled biasing force for the leg 116. The leaf spring configuration may provide flexibility and resilience while occupying a compact space within the heel stabilizer apparatus 100. In some cases, the leaf spring may be formed from materials such as spring steel or other resilient materials that provide consistent biasing characteristics over repeated loading cycles while maintaining structural integrity during operation.

At least a portion of the leaf spring may be arranged in the leg interior groove 146. The positioning of the leaf spring within the leg interior groove 146 may provide a protected and controlled environment for the spring while enabling the spring to apply biasing force to the leg 116. In some cases, the leg interior groove 146 may be dimensioned to accommodate the leaf spring while allowing the spring to flex and provide the desired biasing characteristics during movement of the leg 116.

The arrangement of the leaf spring within the leg interior groove 146 may enable the leg resilient element 130 to apply force between the leg 116 and the compression post 122 in a controlled manner. The leaf spring may be positioned such that one end engages with surfaces within the leg interior groove 146 while another end contacts the compression post 122 or associated surfaces. In some cases, the leaf spring may be configured to compress when the leg 116 is held in a retracted position by contact with the shell bore 110, and may expand to urge the leg 116 toward deployment when the shell 108 moves relative to the rod 106 to allow passage through the slot 112.

The leg resilient element 130 may enable controlled movement of the leg 116 by providing consistent biasing force that works in conjunction with other components of the heel stabilizer apparatus 100. The spring force provided by the leg resilient element 130 may be selected to ensure reliable deployment of the leg 116 when the apparatus transitions to the second position while allowing retraction when the apparatus returns to the first position. In some cases, the leg resilient element 130 may work with the resilient element 124 to provide coordinated movement characteristics that enable smooth operation of the heel stabilizer apparatus 100 during deployment and retraction cycles.

Referring to FIGS. 5B, 6, and 7, the heel stabilizer apparatus 100 may operate in distinct operational states that correspond to different configurations of the deployable components. The apparatus may transition between a first position and a second position based on forces applied during use, with each position providing different stability characteristics for the footwear.

In the first position, the leg 116 may be in a retracted state entirely within an envelope of an outer surface of the shell 108. The retracted state may position the leg 116 such that no portion of the leg 116 extends beyond the outer boundaries defined by the shell 108, thereby maintaining a compact configuration that preserves the aesthetic appearance of the heel stabilizer apparatus 100. In some cases, the leg 116 may be held in the retracted state by the positioning of the shell 108 relative to the rod 106, with the leg exterior contact surface 144 engaging with the shell bore 110 to prevent deployment through the slot 112.

As further shown in FIG. 5B, in the first position, the leg foot pad 118 may not contact a ground surface. The positioning of the leg 116 within the envelope of the outer surface of the shell 108 may maintain the leg foot pad 118 at a distance from the ground surface, with the shell foot pad 114 serving as the primary contact point between the heel stabilizer apparatus 100 and the ground. In some cases, the retracted configuration may provide a narrow contact area similar to conventional high-heel footwear while maintaining the capability for enhanced stability when needed.

In the second position, at least a portion of the leg 116 may protrude through the slot 112 to provide enhanced stability for the heel stabilizer apparatus 100. The protruding portion of the leg 116 may extend outwardly from the shell 108 through the slot 112, thereby creating an expanded base configuration that increases the contact area with the ground surface. In some cases, the deployment of the leg 116 through the slot 112 may be controlled by the interaction between the leg exterior contact surface 144 and the shell bore chamfer 150, which may guide the leg 116 during the transition from the retracted state to the deployed state.

With reference to FIGS. 6 and 7, in the second position, the leg foot pad 118 may contact the ground surface to provide additional stability and support. The contact between the leg foot pad 118 and the ground surface may create multiple contact points that distribute the load applied to the heel stabilizer apparatus 100 and may reduce pressure concentration compared to the first position. In some cases, the leg foot pad 118 may work in conjunction with the shell foot pad 114 to create a stable base configuration that enhances balance and reduces the risk of instability during use.

The movement of the shell 108 relative to the rod 106 from the first position to the second position may enable the deployment of the leg 116 through the slot 112. As force is applied to the heel stabilizer apparatus 100, the shell 108 may move relative to the rod 106 against the biasing force provided by the resilient element 124. In some cases, the relative movement may cause the slot 112 to align with the leg 116 in a manner that allows the leg resilient element 130 to urge the leg 116 to protrude through the slot 112.

As illustrated in FIG. 5B, a shell travel 148 may represent the range of motion available for the shell 108 relative to the rod 106 during the transition between the first position and the second position. The shell travel 148 may define the distance through which the shell 108 may move along the rod 106 when force is applied to compress the resilient element 124. In some cases, the shell travel 148 may be controlled by dimensional relationships between components of the heel stabilizer apparatus 100 and may be selected to provide adequate deployment of the leg 116 while maintaining structural integrity of the apparatus.

The shell travel 148 may enable controlled deployment of the leg 116 by providing sufficient relative movement between the shell 108 and the rod 106 to allow the leg 116 to extend through the slot 112. As the shell 108 moves relative to the rod 106 within the range defined by the shell travel 148, the positioning of the slot 112 relative to the leg 116 may change to permit deployment. In some cases, the shell travel 148 may be coordinated with the biasing force provided by the leg resilient element 130 to ensure reliable deployment of the leg 116 when the apparatus transitions to the second position.

The movement mechanism may operate through the coordinated interaction of the resilient element 124, the leg resilient element 130, and the relative positioning of the shell 108 and the rod 106. When force is applied to the heel stabilizer apparatus 100, the resilient element 124 may compress to allow the shell 108 to move relative to the rod 106 within the range defined by the shell travel 148. In some cases, this movement may reduce the constraint on the leg 116, allowing the leg resilient element 130 to urge the leg 116 to protrude through the slot 112 and transition the apparatus from the first position to the second position.

The arm 116 may be coupled to the rod 106 and shell 108 through various coupling arrangements that enable controlled deployment functionality. In some cases, the arm 116 may be rotatably coupled to the rod 106 through pivot connections, hinge mechanisms, or rotational joints that allow the arm 116 to rotate from a retracted position to a deployed position. The rotational coupling may include pin joints, ball joints, or flexible connections positioned between the arm 116 and the rod 106. In some aspects, the arm 116 may be rotatably coupled to the shell 108 through similar rotational mechanisms that enable the arm 116 to pivot relative to the shell 108 during deployment.

The rotational coupling arrangements may include cam mechanisms where rotation of the rod 106 relative to the shell 108 causes corresponding rotation of the arm 116 to deploy through the slot 112. In some cases, the arm 116 may be connected to the rod 106 through threaded connections that convert linear motion of the rod 106 into rotational motion of the arm 116. The threaded coupling may include helical grooves or spiral tracks that guide the arm 116 along predetermined rotational paths during deployment.

The arm 116 may alternatively be coupled through flexible connections such as living hinges, elastomeric joints, or spring-loaded pivots that enable both translational and rotational movement. In some aspects, the coupling may include universal joints or multi-axis connections that allow the arm 116 to move in multiple degrees of freedom relative to the rod 106 and shell 108. The flexible coupling arrangements may provide compliance that accommodates variations in ground surface conditions while maintaining deployment functionality.

The coupling mechanisms may include gear arrangements where rotation of the rod 106 drives corresponding rotation of the arm 116 through intermeshing gear teeth or gear trains. In some cases, the gear coupling may provide mechanical advantage that amplifies small rotational movements of the rod 106 into larger deployment movements of the arm 116. The gear arrangements may include planetary gear systems, worm gear mechanisms, or bevel gear configurations positioned within the shell 108.

The arm 116 may be coupled through linkage mechanisms that convert motion between the rod 106 and the arm 116 through interconnected links, levers, or mechanical connections. The linkage coupling may include four-bar mechanisms, slider-crank arrangements, or other kinematic chains that provide controlled motion relationships between components. In some aspects, the linkage mechanisms may provide non-linear motion relationships that enable rapid deployment followed by controlled positioning of the arm 116.

The operational states and movement mechanism may provide enhanced stability characteristics while maintaining the aesthetic appeal of high-heel footwear. In the first position, the heel stabilizer apparatus 100 may present a conventional appearance with the leg 116 retracted entirely within the envelope of the outer surface of the shell 108. In some cases, when additional stability is needed, the application of force may cause the apparatus to transition to the second position where the leg 116 protrudes through the slot 112 and the leg foot pad 118 contacts the ground surface, thereby providing an expanded base configuration that enhances balance and support for the user.

The heel stabilizer apparatus may be configured in various alternative aspects that provide different stability characteristics and deployment configurations. In some cases, the apparatus may include three legs arranged at predetermined angular positions to form a tripod configuration when deployed. The three legs may be positioned at approximately 120 degrees apart around a circumference of the apparatus, thereby creating a triangular base pattern when the legs extend through corresponding slots in the shell. The tripod configuration may provide enhanced stability in multiple directions and may distribute ground contact forces across three contact points rather than a single central contact point.

In another configuration, the heel stabilizer apparatus may include two legs arranged at approximately 180 degrees apart to form a bipod configuration when deployed. The two legs may be positioned on opposite sides of the apparatus and may extend through corresponding slots to create a linear base configuration that provides enhanced stability in a primary direction. In some cases, the bipod configuration may provide a more streamlined deployment mechanism while still offering improved stability compared to conventional heel designs.

The legs may be formed from titanium Grade 5 material to provide high strength and low weight properties for the heel stabilizer apparatus. Titanium Grade 5 material may offer superior strength-to-weight ratio compared to other materials and may provide corrosion resistance and durability for repeated deployment cycles. In some cases, the titanium Grade 5 material may enable the legs to withstand bending forces and impact loads while maintaining structural integrity during use.

The legs may have specific dimensional configurations selected to provide adequate strength and deployment characteristics. In some cases, the legs may have dimensions of approximately 0.063 inches by 0.118 inches by 1.8 inches, with the cross-sectional dimensions providing structural rigidity while allowing passage through corresponding slots in the shell. The length dimension may be selected to provide adequate extension distance for ground contact while fitting within the available space of the heel stabilizer apparatus.

The rod may include a piston head formed from 6061 aluminum material to provide lightweight construction with adequate structural properties. The piston head may have a diameter of approximately 0.18 inches and a length of approximately 0.25 inches, with dimensions selected to fit within the shell bore while providing adequate surface area for force transmission. In some cases, the 6061 aluminum material may provide corrosion resistance and machinability while maintaining structural integrity under applied loads.

The rod may include a rod portion formed from stainless steel 304 material to provide strength and durability for the heel stabilizer apparatus. The rod portion may have a diameter of approximately 0.125 inches and a length of approximately 2.5 inches, with dimensions selected to provide adequate structural support while fitting within the available space of the apparatus. In some cases, the stainless steel 304 material may provide corrosion resistance and strength characteristics suitable for repeated loading cycles during operation.

The shell may be formed from ABS material and may be manufactured using 3D printing technology to enable precise dimensional control and complex geometric features. The ABS material may provide adequate strength and durability while allowing cost-effective manufacturing of the shell with integrated features such as slots and internal surfaces. In some cases, 3D printing technology may enable customization of the shell geometry for different heel configurations or specific dimensional requirements.

The shell may have specific dimensional configurations selected to accommodate internal components while providing structural integrity. In some cases, the shell may have an outer diameter of approximately 0.23 inches, an inner diameter of approximately 0.19 inches, and a length of approximately 1 inch or 2.5 inches depending on the specific application requirements. The dimensional relationships may provide adequate wall thickness for structural support while maximizing internal volume for component accommodation.

The resilient element may be formed from Elgiloy material to provide superior fatigue resistance and consistent spring characteristics over repeated loading cycles. The Elgiloy material may offer enhanced durability compared to conventional spring materials and may maintain spring properties under various environmental conditions. In some cases, the resilient element may have a spring rate of approximately 90-100 pounds per inch to provide appropriate biasing force for the heel stabilizer apparatus operation.

The resilient element may have specific dimensional configurations selected to provide desired spring characteristics while fitting within the available space of the apparatus. In some cases, the resilient element may have an outer diameter of approximately 0.156 inches and a length of approximately 1 inch or 2.5 inches depending on the specific force requirements and available space within the rod bore. The dimensional parameters may be coordinated with the spring rate to provide appropriate compression characteristics for the intended application.

The shell may include angled guides configured to control leg deployment during operation of the heel stabilizer apparatus. The angled guides may have predetermined angular orientations such as approximately 0.53 degrees or 24.2 degrees relative to a longitudinal axis of the apparatus. In some cases, the angled guides may direct the movement path of the legs during deployment and may ensure consistent positioning of the legs when the apparatus transitions between the first position and the second position.

The leg foot pads may include rubber caps to provide protection against floor damage during ground contact. The rubber caps may be positioned at extending ends of the legs and may provide a cushioned interface between the legs and ground surfaces. In some cases, the rubber caps may be formed from materials selected for durability and non-marking characteristics, thereby preventing damage to flooring surfaces while providing adequate traction for stability enhancement.

The heel stabilizer apparatus may include a sliding collar with angled guides to provide controlled movement of the legs through the slots during deployment. The sliding collar may be positioned within the shell and may include guide surfaces that direct the legs along predetermined paths as the apparatus transitions between positions. In some cases, the angled guides of the sliding collar may work in conjunction with the leg resilient elements to ensure smooth and consistent deployment of the legs through the slots.

The rod may include an O-ring seal formed from EPDM material to provide sealing within the shell during operation. The EPDM O-ring may be positioned between the rod and the shell bore to prevent contamination and may maintain smooth sliding operation between components. In some cases, the EPDM material may provide chemical resistance and durability while maintaining sealing effectiveness over repeated movement cycles.

The heel stabilizer apparatus may be integrated into a stiletto heel formed from clear Perspex material to provide aesthetic appeal while housing the deployment mechanism. The clear Perspex material may allow visual inspection of internal components while providing structural support for the heel stabilizer apparatus. In some cases, the integration with the Perspex heel may enable the apparatus to maintain the appearance of conventional high-heel footwear while providing enhanced stability capabilities.

The legs may be configured to extend a predetermined distance to form a specific base diameter for ground contact. In some cases, the legs may extend approximately 0.5 inches from the shell to form a base diameter of approximately 1 inch when deployed. The extension distance may be controlled by the interaction between the legs and the angled guides, and may provide adequate ground contact area for stability enhancement while maintaining a compact retracted configuration.

The resilient element may be configured to provide specific force characteristics for cushioning and retraction of the heel stabilizer apparatus. In some cases, the resilient element may provide approximately 7-8 pounds of force at 2 millimeters of compression to enable controlled deployment while ensuring reliable retraction when external forces are removed. The force parameters may be selected to provide appropriate response characteristics for typical user weights and walking forces.

The heel stabilizer apparatus may include a bracket formed from ABS material to provide attachment between the legs and the rod. The bracket may be positioned within the apparatus and may provide mounting points for the legs while allowing controlled movement relative to other components. In some cases, the ABS bracket may be formed using manufacturing processes that enable precise dimensional control and may provide adequate strength for force transmission between the legs and the rod.

The slots may have specific dimensional configurations selected to accommodate leg movement while maintaining structural integrity of the shell. In some cases, the slots may have dimensions of approximately 0.063 inches by 0.118 inches to provide adequate clearance for the legs during deployment and retraction. The slot dimensions may be coordinated with the leg cross-sectional dimensions to enable smooth movement while minimizing gaps that could allow contamination or affect the aesthetic appearance of the apparatus.

The heel stabilizer apparatus may include silicone grease to reduce friction in the sliding mechanism and enhance operational smoothness. The silicone grease may be applied to contact surfaces between moving components such as the rod and shell bore, the legs and slots, or other sliding interfaces within the apparatus. In some cases, the silicone grease may provide lubrication that reduces wear and ensures consistent operation over repeated deployment cycles while maintaining compatibility with the materials used in the apparatus construction.

The structural components of the heel stabilizer apparatus may be formed from various materials selected to provide appropriate mechanical properties, durability, and manufacturing characteristics for the intended application. The shell may be formed from polymeric materials such as ABS, nylon, polycarbonate, or other thermoplastic materials that provide adequate strength and dimensional stability while enabling cost-effective manufacturing. In some cases, the shell may comprise composite materials that combine polymeric matrices with reinforcing fibers such as carbon fiber, glass fiber, or aramid fiber to enhance strength-to-weight ratios. The shell may alternatively be formed from metallic materials including aluminum alloys, titanium alloys, or stainless steel alloys where enhanced structural properties are required. Manufacturing processes for the shell may include 3D printing technologies such as selective laser sintering (SLS) or fused deposition modeling (FDM), injection molding for high-volume production, or CNC machining for precision applications. Surface treatments for the shell may include ceramic tumbling, sanding, polishing, or coating applications to enhance appearance and durability characteristics.

The rod may be formed from metallic materials selected to provide high strength and fatigue resistance under repeated loading conditions. In some cases, the rod may comprise stainless steel alloys such as 304 stainless steel, 316 stainless steel, or 17-4 PH stainless steel that provide corrosion resistance and mechanical properties suitable for the application. The rod may alternatively be formed from titanium alloys such as Grade 5 titanium (Ti-6Al-4V) to provide superior strength-to-weight characteristics and biocompatibility. Other metallic options for the rod may include aluminum alloys such as 6061 aluminum, 7075 aluminum, or precipitation-hardened aluminum alloys that offer lightweight construction with adequate structural properties. Manufacturing processes for the rod may include CNC machining, powder bed fusion (PBF) 3D printing for complex geometries, or conventional machining operations. Surface treatments for the rod may include tumbling, electropolishing, anodizing, or passivation to enhance corrosion resistance and surface finish characteristics.

The top post and compression post may be formed from materials similar to the rod, with selection based on structural requirements and manufacturing considerations. These components may comprise titanium alloys such as Grade 5 titanium to provide high strength and low weight properties, or may be formed from stainless steel alloys where cost considerations are prioritized. In some cases, the posts may be manufactured using powder bed fusion 3D printing to enable complex internal geometries and integrated features. Alternative manufacturing approaches may include CNC machining from solid stock or investment casting for high-volume production. Surface finishing for the posts may include tumbling and electropolishing to achieve smooth surfaces and enhanced fatigue resistance.

Contact surface components including the shell foot pad and leg foot pads may be formed from elastomeric materials selected to provide appropriate hardness, durability, and traction characteristics. The foot pads may comprise rubber materials with Shore C hardness ratings ranging from 50 to 60 to provide optimal balance between cushioning and structural support. Specific rubber formulations may include natural rubber, synthetic rubber compounds, neoprene, silicone rubber, or polyurethane elastomers depending on environmental requirements and performance specifications. In some cases, the foot pads may be formed from thermoplastic elastomers (TPE) that enable injection molding manufacturing while providing rubber-like properties. Manufacturing processes for foot pads may include injection molding for high-volume production, compression molding for specialized compounds, or selective laser sintering for custom geometries. Surface treatments for foot pads may include texturing to enhance traction characteristics or coating applications to provide specific surface properties.

Resilient elements including the primary resilient element and leg resilient elements may be formed from spring materials selected to provide appropriate elastic properties, fatigue resistance, and environmental durability. The resilient elements may comprise spring steel alloys such as 302 stainless steel, 316 stainless steel, or high-carbon steel that provide consistent spring characteristics over repeated loading cycles. In some cases, the resilient elements may be formed from specialty spring alloys such as Elgiloy, Inconel, or Hastelloy that offer enhanced fatigue resistance and temperature stability. Alternative materials for resilient elements may include superelastic alloys such as nitinol (nickel-titanium) that provide unique shape memory and superelastic properties. For flat spring applications, materials may include EN45 spring steel, EN47 spring steel, or 316 stainless steel depending on strength and corrosion resistance requirements. Manufacturing processes for resilient elements may include stamping for flat springs, coiling for helical springs, or wire forming for complex geometries. Surface treatments may include shot peening to enhance fatigue life, stress relieving to optimize spring properties, or coating applications for corrosion protection.

Fastening elements including screws and threaded components may be formed from materials selected to provide adequate strength and corrosion resistance for the assembly requirements. Screws may comprise titanium alloys such as Grade 2 titanium or Grade 5 titanium to provide high strength-to-weight ratios and excellent corrosion resistance. In some cases, fasteners may be formed from stainless steel alloys such as 316 stainless steel or 17-4 PH stainless steel that offer good mechanical properties and corrosion resistance at lower cost. Alternative fastener materials may include aluminum alloys for lightweight applications or specialty alloys for specific environmental requirements. Manufacturing processes for fasteners may include CNC machining for custom geometries, cold heading for standard configurations, or powder bed fusion 3D printing for integrated fastening features. Surface treatments for fasteners may include passivation for stainless steel components, anodizing for aluminum alloys, or specialized coatings for enhanced performance characteristics.

Interface components including seals, pads, and low-friction surfaces may be formed from materials selected to provide appropriate tribological properties and environmental resistance. Sealing elements such as O-rings may comprise elastomeric materials such as EPDM rubber, nitrile rubber, fluorocarbon rubber, or silicone rubber depending on chemical compatibility and temperature requirements. Low-friction surfaces may be formed from materials such as PTFE (polytetrafluoroethylene), UHMWPE (ultra-high molecular weight polyethylene), or other fluoropolymer materials that provide low coefficient of friction and wear resistance. In some cases, interface components may comprise composite materials that combine low-friction properties with structural support characteristics. Manufacturing processes for interface components may include compression molding for elastomeric seals, machining for precision tolerances, or stamping for thin-section components. Surface treatments may include plasma treatment to enhance bonding characteristics or specialized coatings to provide specific surface properties.

The material selection for each component may be based on performance criteria including mechanical strength, fatigue resistance, corrosion resistance, temperature stability, and manufacturing considerations. In some cases, material choices may be influenced by regulatory requirements, cost constraints, or specific application environments. The manufacturing processes may be selected to optimize dimensional accuracy, surface finish, production volume, and cost effectiveness while maintaining the required material properties. Surface treatments and finishing operations may be applied to enhance performance characteristics, improve appearance, or provide specific functional properties such as wear resistance or biocompatibility.

The structural configuration and deployment mechanism of the heel stabilizer apparatus 100 may be adapted for various applications beyond footwear stabilization that may be reasonably contemplated by one of ordinary skill in the art. The core functionality provided by the shell 108, rod 106, legs 116, slots 112, and resilient elements 124, 130 may remain substantially unchanged while the heel connection 102 may be modified to accommodate different mounting requirements. Various illustrative examples of alternative applications are provided below.

The heel stabilizer apparatus 100 may be integrated into walking canes by replacing the heel connection 102 with a cane attachment mechanism configured to secure the apparatus to a cane shaft. The cane attachment mechanism may comprise a cylindrical sleeve or clamp arrangement that engages with the lower portion of a walking cane while maintaining the structural integrity of the deployment system. In some cases, the shell 108, rod 106, legs 116, and associated resilient elements 124, 130 may remain functionally identical to the footwear application, with the slots 112 positioned to allow leg deployment when the cane contacts uneven ground surfaces. The cane attachment mechanism may be formed from materials such as aluminum or stainless steel and may include threaded connections or compression fittings to provide secure mounting to cane shafts having diameters ranging from approximately 0.75 inches to 1.25 inches.

The apparatus 100 may be incorporated into walker legs by substituting the heel connection 102 with walker leg attachment hardware configured to mount the stabilizing mechanism to walker frame members. The walker leg attachment hardware may comprise bracket assemblies or clamp mechanisms that engage with tubular walker legs while providing secure mounting for the shell 108 and associated components. In some cases, multiple apparatus units may be deployed across walker legs to provide enhanced stability on uneven surfaces, with each unit maintaining the same core functionality of the rod 106, legs 116, slots 112, and resilient elements 124, 130. The walker leg attachment hardware may be configured to accommodate standard walker leg diameters of approximately 1 inch to 1.5 inches and may include adjustment mechanisms to ensure proper alignment of the deployment mechanism relative to ground contact surfaces.

The heel connection 102 may be replaced with crutch tip mounting systems while maintaining the core functionality of the shell 108, rod 106, legs 116, and resilient elements 124, 130 for crutch stabilization applications. The crutch tip mounting system may comprise threaded connections or bayonet-style attachments that engage with standard crutch tip receptacles while providing secure mounting for the deployment mechanism. In some cases, the crutch tip mounting system may be configured to replace conventional rubber crutch tips and may include the shell foot pad 114 configured for ground contact in the retracted position. The legs 116 may deploy through the slots 112 when additional stability is required on uneven surfaces, with the leg foot pads 118 providing expanded ground contact area to prevent crutch slippage or instability.

The heel connection 102 may comprise interchangeable mounting interfaces that accommodate different mobility devices while preserving the deployment mechanism functionality. The modular attachment configurations may include threaded adapters, clamp assemblies, or quick-release mechanisms that enable the same apparatus 100 to be transferred between different applications such as canes, walkers, or crutches. In some cases, the universal mounting systems may include standardized connection interfaces that engage with the shell 108 and rod 106 while providing device-specific attachment hardware for different mobility aids. The modular approach may enable cost-effective deployment of the stabilizing technology across multiple mobility devices while maintaining consistent performance characteristics of the legs 116, resilient elements 124, 130, and deployment mechanism.

The apparatus 100 may be integrated into furniture legs by modifying the heel connection 102 to furniture mounting hardware, enabling chairs, tables, or other furniture to deploy stabilizing legs 116 when loaded. The furniture mounting hardware may comprise threaded inserts, bolt connections, or welded attachments that secure the apparatus to furniture leg structures while maintaining the functionality of the shell 108, rod 106, and deployment mechanism. In some cases, the furniture application may utilize the same core components including the slots 112, legs 116, leg foot pads 118, and resilient elements 124, 130, with deployment occurring when furniture loading exceeds predetermined thresholds. The furniture mounting hardware may be configured to accommodate various leg geometries and may include protective finishes to complement furniture aesthetics while providing enhanced stability on uneven floor surfaces.

The heel connection 102 may be configured for camera tripods, medical equipment stands, or other support structures requiring enhanced stability through modification to tripod and equipment mounting interfaces. The tripod attachment configuration may comprise threaded connections compatible with standard tripod leg assemblies or equipment mounting systems while maintaining the deployment functionality of the shell 108, rod 106, legs 116, and resilient elements 124, 130. In some cases, the apparatus 100 may be integrated into each leg of a tripod system to provide enhanced stability when deployed on uneven surfaces, with the legs 116 extending through the slots 112 to create expanded contact areas that prevent equipment movement or vibration. The tripod mounting configuration may include dimensional specifications compatible with standard tripod leg diameters ranging from approximately 0.5 inches to 2 inches and may provide load ratings suitable for camera equipment, medical devices, or other precision instruments requiring stable support platforms.

A method of operating a heel stabilizer apparatus for a shoe may provide enhanced stability functionality through controlled deployment of stabilizing elements in response to applied forces. The method may enable transition between retracted and deployed configurations to provide stability enhancement when needed while maintaining conventional heel appearance during normal use.

The method may comprise providing a heel stabilizer apparatus comprising a shell having a base and at least one slot arranged in a sidewall of the shell, a rod movably arranged relative to the shell, and a leg movably coupled to the rod. The heel stabilizer apparatus may be configured with these components arranged to enable controlled deployment functionality through relative movement between the shell and the rod. In some cases, the apparatus may be integrated into footwear during manufacturing or may be retrofitted to existing heel structures to provide enhanced stability capabilities.

The shell having a base may provide structural foundation for the heel stabilizer apparatus and may house internal components during operation. The base of the shell may be positioned to contact ground surfaces and may provide primary support for the apparatus when in a retracted configuration. In some cases, the shell may be formed from materials selected for durability and may include features such as foot pads to enhance ground contact characteristics.

The at least one slot arranged in a sidewall of the shell may provide an opening through which deployable components may extend during operation. The slot may be positioned and dimensioned to accommodate passage of the leg while maintaining structural integrity of the shell. In some cases, multiple slots may be provided at predetermined positions to enable deployment of multiple legs for enhanced stability characteristics.

The rod movably arranged relative to the shell may provide a structural element that enables controlled relative movement within the apparatus. The rod may be positioned within the shell and may be configured to slide or translate relative to the shell in response to applied forces. In some cases, the rod may include features such as bores or mounting surfaces to accommodate other components of the apparatus.

The leg movably coupled to the rod may provide a deployable element that extends through the slot to enhance stability when the apparatus is activated. The leg may be connected to the rod through coupling mechanisms that enable the leg to respond to relative movement between the shell and the rod. In some cases, the leg may include foot pads or contact surfaces to provide enhanced ground contact when deployed.

The method may comprise applying a force to the heel stabilizer apparatus to initiate deployment of stabilizing elements. The applied force may result from user weight, walking forces, or other loads transmitted through footwear during use. In some cases, the force may be applied through heel contact with the apparatus and may be sufficient to overcome biasing forces that maintain the apparatus in a retracted configuration.

The applied force may be transmitted through the heel stabilizer apparatus to internal components that control deployment functionality. The force transmission may cause compression or movement of resilient elements within the apparatus and may enable relative movement between the shell and the rod. In some cases, the magnitude and direction of the applied force may determine the extent of deployment and the stability characteristics provided by the apparatus.

The method may comprise moving the shell relative to the rod from a first position to a second position in response to the applied force. The movement from the first position to the second position may enable deployment of stabilizing elements by changing the spatial relationship between components of the apparatus. In some cases, the first position may correspond to a retracted configuration where stabilizing elements are contained within the apparatus, while the second position may correspond to a deployed configuration where stabilizing elements extend outwardly to provide enhanced stability.

The movement of the shell relative to the rod may occur through sliding or translational motion along a longitudinal axis of the apparatus. The relative movement may be guided by engagement between the shell and the rod and may be controlled by dimensional relationships between components. In some cases, the range of movement may be limited by mechanical stops or constraints within the apparatus to prevent over-travel and ensure proper positioning in the second position.

The transition from the first position to the second position may involve compression of resilient elements within the apparatus that provide biasing forces. The applied force may overcome the biasing forces to enable relative movement between the shell and the rod. In some cases, the force required to initiate movement may be selected to provide appropriate response characteristics for typical use conditions while preventing inadvertent deployment during normal handling.

The method may comprise moving at least a portion of the leg to protrude through the at least one slot as the shell moves from the first position to the second position. The movement of the leg through the slot may provide enhanced stability by creating an expanded base configuration that increases ground contact area. In some cases, the leg movement may be coordinated with the shell movement to ensure proper timing and positioning of deployable elements.

The movement of at least a portion of the leg to protrude through the slot may be enabled by the relative movement between the shell and the rod that changes the constraint conditions for the leg. In the first position, the leg may be constrained within the apparatus by the positioning of the shell relative to the rod. In some cases, as the shell moves to the second position, the constraint on the leg may be reduced or eliminated, allowing the leg to extend through the slot under the influence of biasing forces.

The protrusion of the leg through the slot may create an extended configuration where the leg extends outwardly from the shell to contact ground surfaces. The extended leg may provide additional contact points that distribute applied loads and may enhance stability characteristics of the footwear. In some cases, the extent of leg protrusion may be controlled by mechanical limits or contact surfaces within the apparatus to ensure consistent deployment characteristics.

The method may further comprise biasing the leg to protrude through the at least one slot via a leg resilient element coupled with the leg. The leg resilient element may provide a biasing force that urges the leg toward an extended position where the leg protrudes through the slot. In some cases, the biasing force may be applied continuously, with the leg being held in a retracted position by constraints that are removed when the apparatus transitions from the first position to the second position.

The leg resilient element coupled with the leg may comprise a spring or other resilient component positioned to apply force between the leg and other components of the apparatus. The leg resilient element may be compressed or tensioned when the leg is in a retracted position and may expand or relax to urge the leg toward deployment when constraints are removed. In some cases, the leg resilient element may be positioned between the leg and a compression post or other structural element to provide controlled biasing characteristics.

The biasing action of the leg resilient element may enable rapid and consistent deployment of the leg when the apparatus transitions to the second position. The biasing force may overcome friction and other resistive forces to ensure reliable extension of the leg through the slot. In some cases, the spring characteristics of the leg resilient element may be selected to provide appropriate deployment force while allowing controlled retraction when the apparatus returns to the first position.

The method may further comprise biasing the rod and the shell to the first position via a resilient element arranged between the rod and the shell. The resilient element may provide a restoring force that urges the rod and the shell toward the first position when external forces are removed from the apparatus. In some cases, the resilient element may be compressed when the apparatus is in the second position and may expand to return the apparatus to the first position when applied forces are reduced or eliminated.

The resilient element arranged between the rod and the shell may comprise a spring or other biasing component positioned to apply force between these components. The resilient element may be configured to maintain the apparatus in the first position under normal conditions and may be overcome by applied forces to enable transition to the second position. In some cases, the resilient element may be positioned within a bore of the rod or between mounting surfaces associated with the rod and the shell.

The biasing action of the resilient element may provide automatic retraction functionality that returns the apparatus to the first position when external forces are removed. The restoring force provided by the resilient element may cause the shell to move relative to the rod back to the first position, thereby constraining the leg and causing retraction through the slot. In some cases, the spring characteristics of the resilient element may be coordinated with the leg resilient element to provide smooth and controlled retraction of deployable components.

The coordinated operation of the resilient element and the leg resilient element may enable controlled deployment and retraction cycles that provide stability enhancement when needed while maintaining conventional appearance during normal use. The resilient element may control the transition between the first position and the second position, while the leg resilient element may control the deployment of the leg through the slot. In some cases, the force characteristics of both resilient elements may be selected to provide appropriate response to user weight and walking forces while ensuring reliable operation over repeated cycles.

The method may enable enhanced stability functionality for high-heel footwear by providing deployable stabilizing elements that extend when additional support is needed. The deployment may occur automatically in response to applied forces without requiring manual activation or complex control mechanisms. In some cases, the method may provide improved balance and reduced risk of instability while maintaining the aesthetic appeal of conventional high-heel designs during normal use conditions.

A number of implementations have been described. Nevertheless, it will be understood that various modifications may be made without departing from the spirit and scope of the disclosure. Accordingly, other implementations are within the scope of the following claims.

The invention claimed is:

1. A heel stabilizer apparatus for a shoe, comprising:
a shell comprising a base;
at least one slot arranged in a sidewall of the shell;
a rod movably arranged relative to the shell; and
a leg movably coupled to the rod;
wherein a movement of the shell relative to the rod from a first position to a second position moves at least a portion of the leg to protrude through the at least one slot.

2. The apparatus of claim 1, further comprising:
a leg resilient element coupled with the leg;
wherein the leg resilient element is configured to bias the leg to protrude through the at least one slot.

3. The apparatus of claim 2, further comprising:
a compression post coupled to the shell;
wherein the leg resilient element comprises a spring positioned between the leg and at least a portion of the compression post.

4. The apparatus of claim 3, wherein:
the leg comprises a leg interior groove;
the spring comprises a leaf spring; and
at least a portion of the leaf spring is arranged in the leg interior groove.

5. The apparatus of claim 2, wherein:

the shell comprises a shell bore forming an interior surface of the shell; and the leg comprises an exterior contact surface configured to contact the shell bore in the first position.

6. The apparatus of claim 5, wherein:

the shell bore comprises a shell bore chamfer adjacent the at least one slot; and the exterior contact surface configured to contact the shell bore chamfer in the second position.

7. The apparatus of claim 3, wherein:

the leg comprises a faceted top surface.

8. The apparatus of claim 7, wherein:

the faceted top surface comprises a top contact surface and a side contact surface;

the top contact surface configured to contact a bottom surface of the rod in the second position; and the side contact surface configured to contact the compression post in the second position.

9. The apparatus of claim 1, further comprising:

a resilient element arranged between the rod and the shell;

wherein the resilient element is configured to bias the rod and the shell to the first position.

10. The apparatus of claim 9, wherein:

the rod comprises a rod bore; and the resilient element is arranged in the rod bore.

11. The apparatus of claim 9, wherein:

the resilient element comprises a helical spring.

12. The apparatus of claim 9, wherein:

the rod comprises a top post;

the shell comprises a compression post; and the resilient element is arranged between the top post and the compression post.

13. The apparatus of claim 1, wherein:

the shell comprises a foot pad configured to contact a ground surface; and the leg comprises a leg foot pad configured to contact the ground surface in the second position.

14. The apparatus of claim 13, wherein:

the leg foot pad does not contact the ground surface in the first position.

15. The apparatus of claim 1, wherein:

in the first position, the leg is in a retracted state entirely within an envelope of an outer surface of the shell.

16. A method of operating a heel stabilizer apparatus for a shoe, comprising:

providing a heel stabilizer apparatus comprising a shell having a base and at least one slot arranged in a sidewall of the shell, a rod movably arranged relative to the shell, and a leg movably coupled to the rod;

applying a force to the heel stabilizer apparatus;

moving the shell relative to the rod from a first position to a second position in response to the applied force; and moving at least a portion of the leg to protrude through the at least one slot as the shell moves from the first position to the second position.

17. The method of claim 16, further comprising:

biasing the leg to protrude through the at least one slot via a leg resilient element coupled with the leg.

18. The method of claim 16, further comprising:

biasing the rod and the shell to the first position via a resilient element arranged between the rod and the shell.

* * * * *